US008971758B2

(12) United States Patent
Kamimura

(10) Patent No.: US 8,971,758 B2
(45) Date of Patent: Mar. 3, 2015

(54) PHOTOSENSITIVE MEMBER CARTRIDGE, PROCESS CARTRIDGE AND IMAGE FORMING APPARATUS USING THE SAME

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 71 days.

(21) Appl. No.: 13/598,709

(22) Filed: Aug. 30, 2012

(65) Prior Publication Data

US 2013/0051846 A1 Feb. 28, 2013

(30) Foreign Application Priority Data

Aug. 31, 2011 (JP) ..... 2011-190040

(51) Int. Cl.
*G03G 21/16* (2006.01)
*G03G 21/18* (2006.01)
*G03G 15/00* (2006.01)

(52) U.S. Cl.
CPC ..... *G03G 21/181* (2013.01); *G03G 15/751* (2013.01)
USPC ..... 399/111

(58) Field of Classification Search
USPC ..... 399/107, 110, 111, 113, 119, 120
See application file for complete search history.

(56) References Cited

U.S. PATENT DOCUMENTS 4,757,342 A 7/1988 Ogura et al.
5,583,613 A 12/1996 Kobayashi et al.
5,870,654 A * 2/1999 Sato et al. ..... 399/109
6,272,300 B1 * 8/2001 Fujiwara et al. ..... 399/113
6,731,893 B2 5/2004 Okoshi
7,515,865 B2 4/2009 Matsushima et al.
2003/0012583 A1 1/2003 Okoshi
2005/0220517 A1 10/2005 Matsushima et al.

FOREIGN PATENT DOCUMENTS

CN 1397850 A 2/2003
CN 1677258 A 10/2005
JP 62153964 A 7/1987
JP H05-142873 A 6/1993
JP H06-258875 A 9/1994
JP 2002-108171 A 4/2002

OTHER PUBLICATIONS

CN Notification of the First Office Action mailed Mar. 5, 2014, CN Appln. 201210324349.1, English translation.

* cited by examiner

*Primary Examiner* — Hoan Tran
(74) *Attorney, Agent, or Firm* — Banner & Witcoff, Ltd.

(57) ABSTRACT

A photosensitive member cartridge includes: a photosensitive member extending in an axial direction; a frame including a pair of photosensitive member receiving portions configured to receive axial end portions of the photosensitive member; and a pair of holding members configured to hold the axial end portions of the photosensitive member. The frame includes a first frame and a second frame separable from each other in a prescribed direction perpendicular to the axial direction and mating with each other such that the first frame provides a part of each photosensitive member receiving portion and the second frame provides a remaining part of each photosensitive member receiving portion. Each of the holding members is engaged with both of the first frame and the second frame.

16 Claims, 12 Drawing Sheets

PHOTOSENSITIVE MEMBER CARTRIDGE, PROCESS CARTRIDGE AND IMAGE FORMING APPARATUS USING THE SAME

CROSS REFERENCE TO RELATED APPLICATION

This application claims priority from Japanese Patent Application No. 2011-190040 filed Aug. 31, 2011. The entire content of the priority application is incorporated herein by reference.

TECHNICAL FIELD

The present invention relates to an electro-photographic type image forming apparatus, a photosensitive member cartridge and a process cartridge for use in the image forming apparatus.

BACKGROUND

Known is an electro-photographic type tandem color laser printer that detachably accommodates a plurality of photosensitive member cartridges. Such photosensitive member cartridge includes a cartridge frame formed with bearing portions, and a photosensitive drum whose lateral end portions are supported to the bearing portions of the cartridge frame.

Among such photosensitive member cartridges, there is proposed a photosensitive member cartridge whose cartridge frame is separable into an upper frame and a lower frame. Specifically, the cartridge frame can be divided into the upper and lower frames along a plane passing through a vertical center of each bearing portion.

This photosensitive member cartridge is assembled such that its photosensitive drum is first assembled to the lower frame and subsequently the upper frame is engaged with the lower frame. Assembly of the photosensitive drum to the cartridge frame is thus facilitated, compared to a case where a cartridge frame is integrally formed.

SUMMARY

In the above-described photosensitive member cartridge, rigidity of the cartridge frame could be insufficient since the cartridge frame is configured of the upper frame and the lower frame. Therefore, conceivably, the photosensitive drum supported to the cartridge frame may not be accurately positioned relative to the cartridge frame. As a result, when the photosensitive member is mounted in a main body of a printer, positioning accuracy of the photosensitive drum relative to the main body may not be obtained sufficiently, possibly leading to image formation failure.

In view of the foregoing, it is an object of the present invention to provide a photosensitive member cartridge capable of facilitating assembly of a photosensitive member to an upper frame and a lower frame, while capable of realizing accurate positioning of the photosensitive member relative to the upper and lower frames. The present invention also aims to provide a process cartridge and an image forming apparatus using the photosensitive member cartridge.

According to an aspect of the present invention, there is provided a photosensitive member cartridge including a photosensitive member, a frame and a pair of holding members. The photosensitive member defines a first axis extending in an axial direction and configured to rotate about the first axis, the photosensitive member having axial end portions opposite to each other in the axial direction. The frame includes a pair of photosensitive member receiving portions configured to receive the axial end portions of the photosensitive member, the frame including a first frame and a second frame separable from each other in a prescribed direction perpendicular to the axial direction and mating with each other such that the first frame provides a part of each photosensitive member receiving portion, and the second frame provides a remaining part of each photosensitive member receiving portion. The pair of holding members is configured to hold the axial end portions of the photosensitive member, each holding member being engaged with both of the first frame and the second frame.

According to another aspect of the present invention, there is provided a process cartridge including a photosensitive member cartridge and a developing cartridge detachably mountable on the photosensitive member cartridge. The photosensitive member cartridge includes a photosensitive member, a frame and a pair of holding members. The photosensitive member defines a first axis extending in an axial direction and configured to rotate about the first axis, the photosensitive member having axial end portions opposite to each other in the axial direction. The frame includes a pair of photosensitive member receiving portions configured to receive the axial end portions of the photosensitive member, the frame including a first frame and a second frame separable from each other in a prescribed direction perpendicular to the axial direction and mating with each other such that the first frame provides a part of each photosensitive member receiving portion, and the second frame provides a remaining part of each photosensitive member receiving portion. The pair of holding members is configured to hold the axial end portions of the photosensitive member, each holding member being engaged with both of the first frame and the second frame. The developing cartridge includes a developing frame and a developer carrying member. The developing frame has end portions opposite to each other in the axial direction. The developer carrying member defines a second axis extending in the axial direction and configured to rotate about the second axis, the developer carrying member being rotatably supported to the end portions of the developing frame, the developer carrying member being in confrontation with and in contact with the photosensitive member when the developing cartridge is mounted on the photosensitive member cartridge.

According to still another aspect of the present invention, there is provided an image forming apparatus including: a process cartridge which includes a photosensitive member cartridge and a developing cartridge detachably mountable on the photosensitive member cartridge; and a main casing in which the process cartridge is detachably mountable. The photosensitive member cartridge includes a photosensitive member, a frame and a pair of holding members. The photosensitive member defines a first axis extending in an axial direction and configured to rotate about the first axis, the photosensitive member having axial end portions opposite to each other in the axial direction. The frame includes a pair of photosensitive member receiving portions configured to receive the axial end portions of the photosensitive member, the frame including a first frame and a second frame separable from each other in a prescribed direction perpendicular to the axial direction and mating with each other such that the first frame provides a part of each photosensitive member receiving portion, and the second frame provides a remaining part of each photosensitive member receiving portion. The pair of holding members is configured to hold the axial end portions of the photosensitive member, each holding member being engaged with both of the first frame and the second frame.

The developing cartridge includes a developing frame and a developer carrying member. The developing frame has end portions opposite to each other in the axial direction. The developer carrying member defines a second axis extending in the axial direction and configured to rotate about the second axis, the developer carrying member being rotatably supported to the end portions of the developing frame, the developer carrying member being in confrontation with and in contact with the photosensitive member when the developing cartridge is mounted on the photosensitive member cartridge.

BRIEF DESCRIPTION OF THE DRAWINGS

The particular features and advantages of the invention as well as other objects will become apparent from the following description taken in connection with the accompanying drawings, in which:

FIGS. 9A-9*c* are left side views explaining how the holding member is assembled to the upper frame and the lower frame, wherein: FIG. 9A shows a left side view of the upper frame and the lower frame in a state where the holding member is not yet assembled thereto; FIG. 9B shows a left side view of the upper frame and the lower frame in a state where the holding member is being assembled to the upper frame and the lower frame; and FIG. 9C shows a left side view of the upper frame and the lower frame in a state where the holding member has been assembled thereto;

FIGS. 12A-12B are views explaining how the process cartridge of FIG. 2 is mounted in the printer of FIG. 1, wherein: FIG. 12A is a back side view of the process cartridge when the process cartridge is being mounted into the main casing of the printer; and FIG. 12B is a back side view of the process cartridge of FIG. 2 when the process cartridge has been mounted in the main casing of the printer.

DETAILED DESCRIPTION

Figure 1:
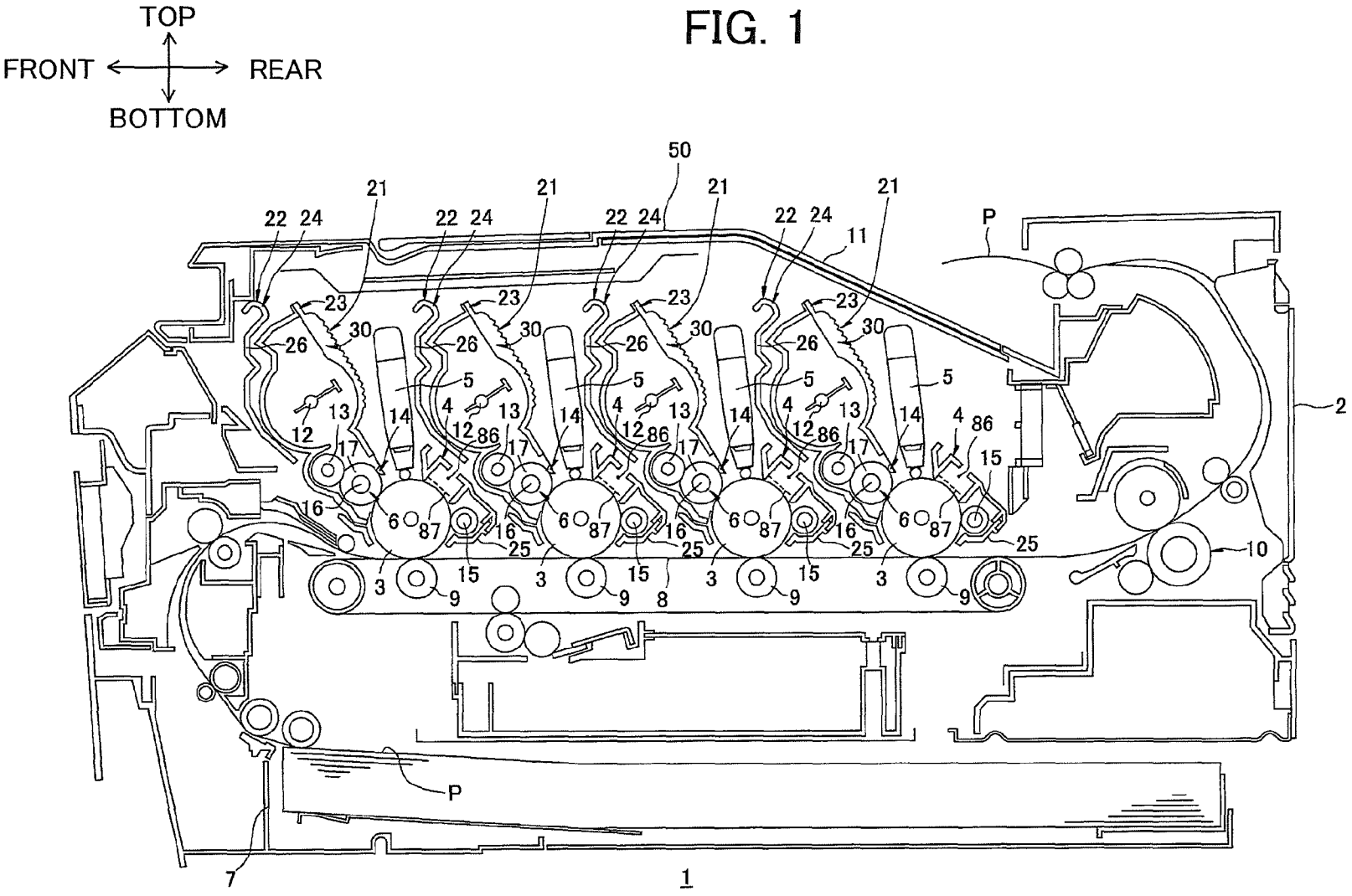
FIG. 1 is a cross-sectional view of a color printer as an image forming apparatus according to one embodiment of the present invention, the color printer including a main casing in which a plurality of process cartridges are mounted.

A printer 1 as an image forming apparatus according to one embodiment of the present invention will be described while referring to FIGS. 1 to 12B wherein like parts and components are designated by the same reference numerals to avoid duplicating description.

1. Overall Structure of Color Printer

As shown in FIG. 1, the printer 1 is a horizontal direct tandem type color printer.

With regard to the printer 1 and a drum cartridge 22 detached from the printer 1 (shown in FIGS. 2 to 9C), directions will be referred to assuming that the printer 1 and the drum cartridge 22 are respectively placed on a horizontal plane. Specifically, directions will be referred to based on those shown in each drawing. Incidentally, a left-to-right direction (a lateral direction) of drum cartridge 22 in FIGS. 2 to 9C will be identical to those of the printer 1 (when the drum cartridge 22 is mounted in the printer 1).

In other words, directions (top-to-bottom and front-to-rear directions) with respect to the printer 1 are different from directions (top-to-bottom and front-to-rear directions) with respect to the drum cartridge 22 detached from the printer 1. The drum cartridge 22 is mounted in the printer 1 such that a front portion of the drum cartridge 22 is oriented toward an upper-front portion of the printer 1, and a rear portion of the drum cartridge 22 is oriented toward a lower-rear portion of the printer 1.

Referring to FIG. 1, the printer 1 includes a main casing 2 having a generally box shape as an example of a claimed main casing. The main casing 2 has an upper end portion provided with a top cover 50 which can be opened or closed. In the main casing 2, four photosensitive drums 3 corresponding to four colors of toner (black, yellow, magenta and cyan) are juxtaposedly arrayed in a front-to-rear direction.

A scorotron charger 4, an LED unit 5 and a developing roller 6 (as an example of a claimed developer carrying member) are provided in confrontation with each photosensitive drum 3.

After an outer peripheral surface of the photosensitive drum 3 is uniformly charged by the scorotron charger 4, the surface is exposed to light by the LED unit 5 based on a predetermined image data to form an electrostatic latent image on the surface. Then a visible toner image corresponding to the electrostatic latent image is formed on the outer peripheral surface of the photosensitive drum 3 by supplying toner carried on the developing roller 6 to the corresponding photosensitive drum 3.

A sheet cassette 7 is provided at a bottom portion of the main casing 2 for accommodating sheets P therein in a stacked state. The sheets P accommodated in the sheet cassette 7 are conveyed to a conveyer belt 8 by a variety of rollers.

The conveyer belt 8 extends in the front-to-rear direction and is disposed at a position immediately below the photosensitive drums 3. Transfer rollers 9 are provided opposite to the photosensitive drums 3 with respect to the conveyer belt 8. The toner image formed on the outer peripheral surface of each photosensitive drum 3 is sequentially transferred and superimposed onto the sheet P due to a transfer bias applied to each transfer roller 9, thereby providing a color image on the sheet P.

The sheet P on which the color image has been formed is then conveyed to a fixing unit 10 provided downstream of the conveyer belt 8. The sheet P on which the color image is formed is thermally fixed to the sheet P at the fixing unit 10. The sheet P carrying the color image is then discharged onto a discharge tray 11 provided at the top cover 50.

2. Structure of Process Cartridge

The printer 1 detachably accommodates therein four process cartridges 21 corresponding to four colors of toner. When mounted, the process cartridges 21 are juxtaposedly arrayed in the front-to-rear direction within the main casing 2. When the top cover 50 is opened, each process cartridge 21 is mountable in and removable from the main casing 2. Each process cartridge 21 includes the drum cartridge 22 and a developing cartridge 23 detachable from and attachable to the drum cartridge 22.

(1) Developing Cartridge

Referring to FIG. 1, each developing cartridge 23 includes a developing cartridge frame 30 having a generally box shape whose lower-rear side is open downward. The developing roller 6 is provided at a lower end portion of the developing cartridge frame 30.

The developing roller 6 extends in a left-to-right direction (lateral direction), and includes a developing roller shaft 16 defining an axis X2 extending in the lateral direction, and a rubber roller 17 provided around the developing roller shaft 16 to cover the same. The rubber roller 17 has a lower-rear portion exposed to an outside from the developing cartridge frame 30. The developing roller shaft 16 has lateral end portions rotatably supported to left and right side walls 31 (see FIG. 2) of the developing cartridge frame 30 respectively such that the developing roller 6 is rotatable about the axis X2 (see FIG. 10). The axis of the developing roller 6 serves as a rotational axis of the developing roller 6 and therefore will be referred to as a "second rotational axis X2" hereinafter.

The developing cartridge 23 also includes a supply roller 13 for supplying toner to the developing roller 6, a regulation blade 14 for regulating a thickness of a toner layer formed on the developing roller 9, and agitator 12. A toner container (shown without a reference numeral) is positioned above the supply roller 13 and the regulation blade 14 for containing toner as a developing agent. The agitator 12 is disposed within the toner container for agitating the toner stored therein.

Figure 10:
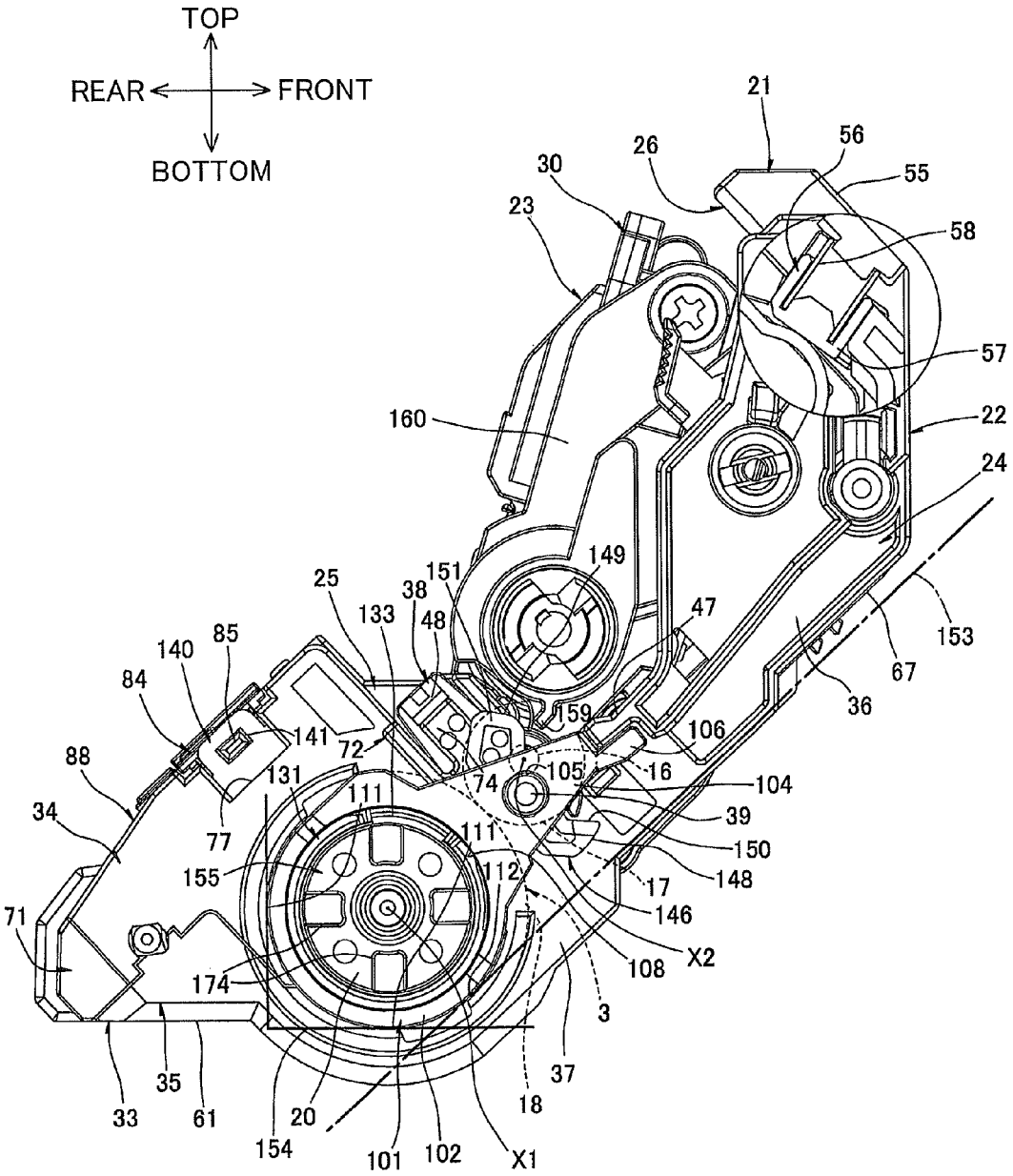
FIG. 10 is a left side view of the process cartridge of FIG. 2 in a state where the process cartridge has been mounted in the printer of FIG. 1, wherein the photosensitive drum is in contact with a developing roller of the developing cartridge.

A gear cover 160 is provided for each lateral end portion of the developing cartridge frame 30, as shown in FIG. 10. Each gear cover 160 has a substantially box shape whose opening is oriented inward in the lateral direction. The gear cover 160 has such a size (lengths in the front-to-rear direction and in a top-to-bottom direction) that the gear cover 160 can entirely cover various gears disposed on each side wall 31 of the developing cartridge frame 30.

Each gear cover 160 has a laterally outer surface on which an abutment portion 159 is formed. More specifically, the abutment portion 159 is provided at a rear portion of the laterally outer surface of the gear cover 160. The abutment portion 159 has a substantially rectangular shape in a side view. As will be described later, each abutment portion 159 has a rear surface that is brought into contact with an abutment surface 149 of each separating member 146 when the developing cartridge 23 is mounted on the drum cartridge 22.

(2) Drum Cartridge

The drum cartridge 22 includes a drum cartridge frame 24 (corresponding to a claimed frame) that is made from a polystyrene. The drum cartridge frame 24 is configured of a lower frame 33 (an example of a claimed first frame) and an upper frame 34 (an example of a claimed second frame).

Figure 3:
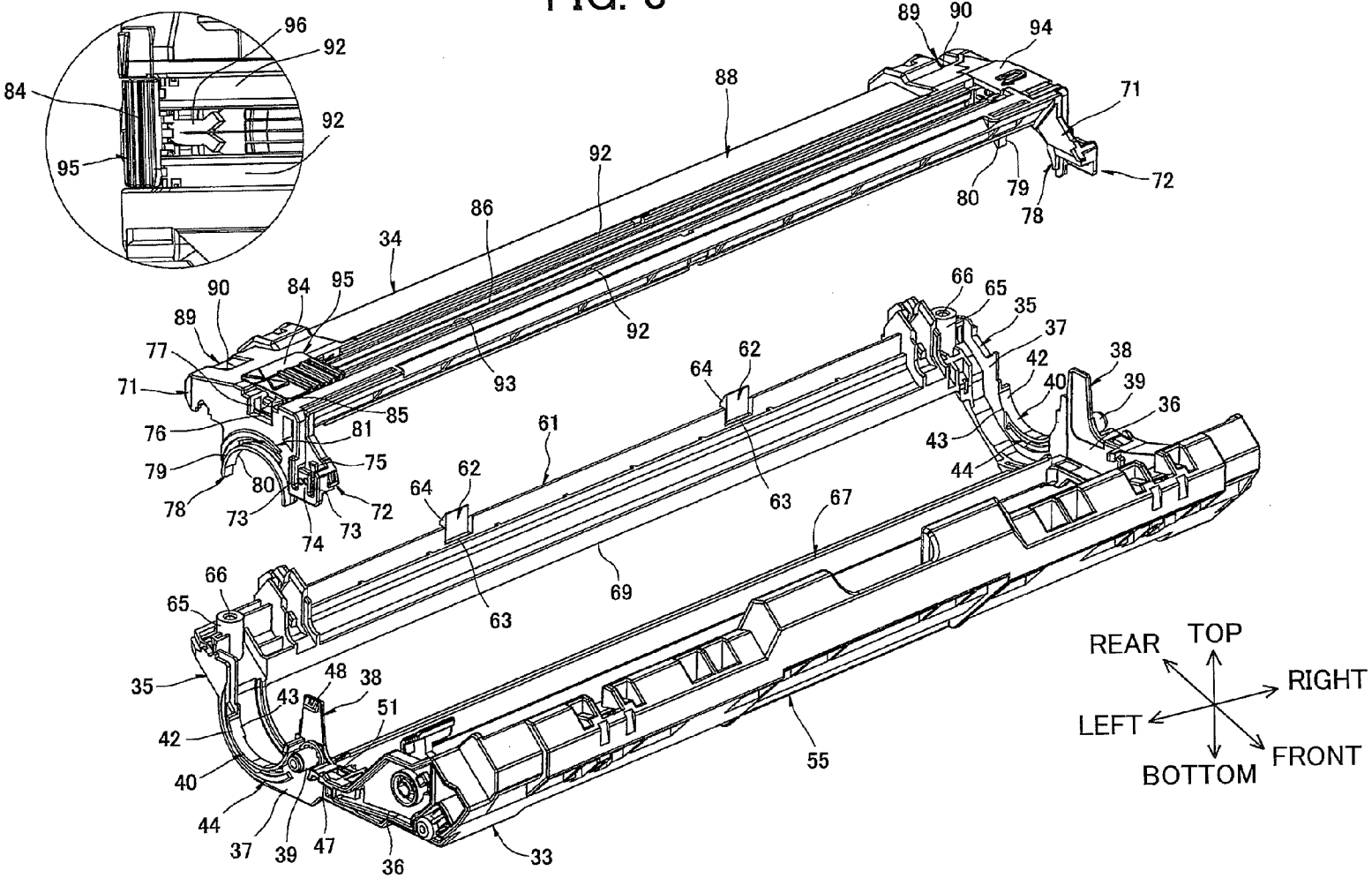
FIG. 3 is a perspective view of an upper frame and a lower frame constituting a drum cartridge frame of the drum cartridge.

The lower frame 33 includes a pair of lower frame side walls 35, a front wall 5, a rear wall 61 and a bottom wall 67, as shown in FIG. 3.

The lower frame side walls 35 are disposed in opposition to each other in the lateral direction. Each lower frame side wall 35 has a frontward portion serving as a front side wall 36 and a rearward portion serving as a rear side wall 37, the front side wall 36 and the rear side wall 37 integrally constituting each lower frame side wall 35.

Figure 9A:
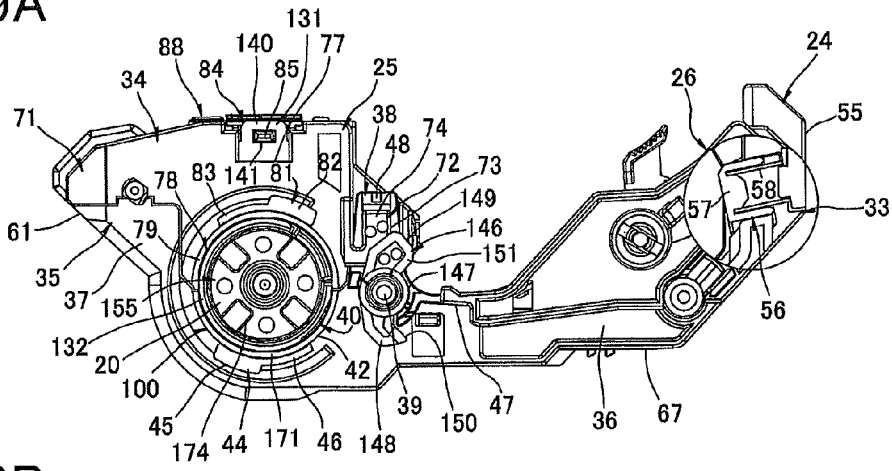
Figure 9B:
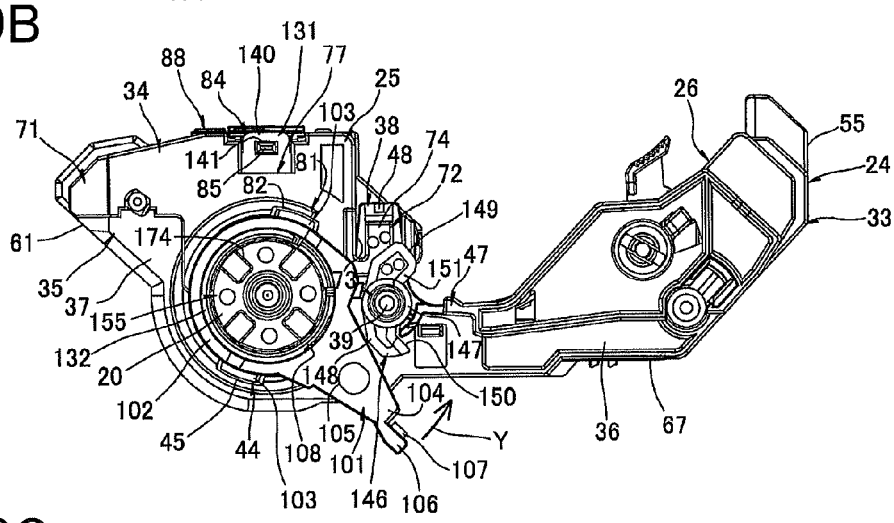
Figure 9C:
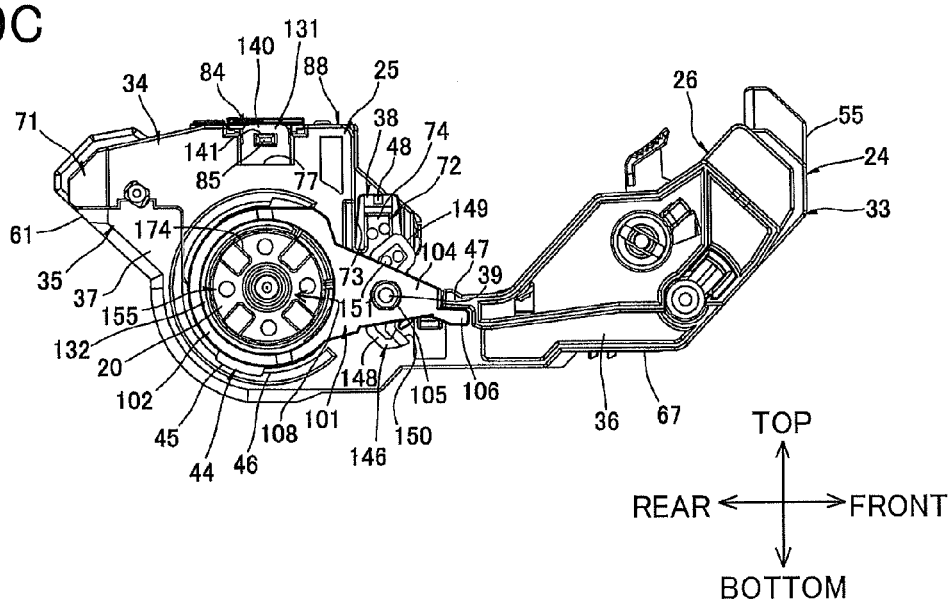

Referring to FIGS. 9A-9C, the front side wall 36 has a rear portion extending in the front-to-rear direction and a front portion extending diagonally upward and frontward from a front end portion of the rear portion.

An engaged portion 47 is formed at a rear end portion of the front side wall 36. The engaged portion 47 has a generally flat plate-like shape, protruding laterally outward from an upper peripheral end portion of an outer surface of each front side wall 36. As shown in FIG. 3, an engaging hole 51 is formed on the engaged portion 47. The engaging hole 51 has a generally rectangular shape in a plan view and penetrates through the engaged portion 47 in the top-to-bottom direction.

The rear side wall 37 has a frontward portion extending rearward from the rear end portion of the front side wall 36, and a rearward portion extending diagonally upward and rearward from a rear end portion of the frontward portion, as shown in FIGS. 9A-9C.

Each rear side wall 37 integrally includes a first frame engaging portion 38, a separation shaft 39 and a lower receiver 40, as shown in FIG. 3.

The first frame engaging portion 38 has a substantially flat plate-like shape, extending upward from an upper peripheral end portion of the frontward portion of the rear side wall 37. The first frame engaging portion 38 has an upper end portion on which a hooked portion 48 is formed. The hooked portion 48 has a generally hook-like shaped cross-section in the top-to-bottom direction, protruding laterally outward from an outer surface of the first frame engaging portion 38.

The separation shaft 39 is disposed on the outer surface of the first frame engaging portion 38. The separation shaft 39 has a generally cylindrical shape protruding laterally outward from the outer surface of the first frame engaging portion 38.

The lower receiver 40 is disposed rearward of the separation shaft 39. The lower receiver 40 includes a lower receiving groove 43 and a lower collar 42. The lower receiving groove 43 is formed on an upper peripheral end of the rear side wall 37 at a position generally center thereof in the front-to-rear direction. The lower receiving groove 43 is depressed downward from the upper peripheral end of the rear side wall 37 to provide a semi-circular shape in a side view. The lower receiving groove 43 has a peripheral end portion from which the lower collar 42 protrudes laterally outward. The lower receiving groove 43 thus has a semi-circular shaped side view, following an outer contour of the lower receiving groove 43.

Also, as shown in FIG. 9A, a lower groove 44 is formed below the lower collar 42. The lower groove 44 is formed in an arcuate shape in conformance with an outer contour of the lower collar 42. The lower groove 44 has a front portion defining a narrow-width groove 46, and a rear portion defining a wide-width groove 45. The wide-width groove 45 has a width about twice as wide as that of the narrow-width groove 46.

The front wall 55 connects between front end portions of the lower frame side walls 35. The front wall 55 is formed so as to extend diagonally upward and frontward, following an outer profile of a lower end portion of the front portion of each front side wall 36. As shown in FIG. 9A, the front wall 55 has an upper end portion on which a pair of pressing mechanisms 56 is provided. Specifically, the pressing mechanisms 56 are disposed on a back surface (rear surface) of the upper end portion of the front wall 55 to oppose each other in the lateral direction. Each pressing mechanism 56 is positionally coincident with each lateral end portion of a front wall of the developing cartridge frame 30 when the developing cartridge 23 is attached to the drum cartridge 22 (also see FIG. 10).

Each pressing mechanism 56 includes a cylindrical portion 57 and a spring member 58. The cylindrical portion 57 has a generally U-shaped cross-section in a side view whose opening is oriented frontward. The spring member 58 has a hollow coil-like shape extending in the front-to-rear direction. The spring member 58 is accommodated within an internal space defined by the cylindrical portion 57. Specifically, in each pressing mechanism 56, the spring member 58 is interposed in a compressed state between a front-side surface of the end wall of the cylindrical portion 57 and the back surface of the upper end portion of the front wall 55. Therefore, the cylindrical portion 57 is movable in the front-to-rear direction relative to the front wall 55 and normally biased rearward due to a biasing force of the spring member 58.

The rear wall 61 connects between rear end portions of the rearward portion of each rear side wall 37. As shown in FIG. 9A, the rear wall 61 extends diagonally upward and rearward in a left side view. The rear wall 61 has an upper end portion on which a pair of cutouts 63 is formed, as shown in FIG. 3. Each cutout 63 has generally U-shape in a front view which is open upward. The cutouts 63 are disposed to oppose each other in the lateral direction with a prescribed distance kept therebetween.

On the rear wall 61, a pair of second frame engaging portions 62 and a pair of lower fixing portions 65 are formed (see FIG. 3).

The second frame engaging portions 62 are disposed in coincidence with the cutouts 63 in the lateral direction. Each second frame engaging portion 62 is formed in a generally flat plate-like shape, having a width in the lateral direction substantially identical to that of each cutout 63 but a height larger than that of the cutout 63 in the top-to-bottom direction. Each second frame engaging portion 62 and its corresponding cutout 63 are integrally formed with each other (integral with the rear wall 61).

Each second frame engaging portion 62 has a rear surface on which a hook portion 64 is formed. The hook portion 64 has a hook-like shaped vertical cross-section, protruding rearward from an upper end portion of the rear surface of the second frame engaging portion 62.

Each lower fixing portion 65 is provided at each lateral end portion of the rear wall 61. The lower fixing portion 65 has a generally cylindrical shape and protrudes upward from an inner peripheral surface of each lateral end portion of the rear wall 61. The lower fixing portion 65 has an upper surface on which a screw hole 66 is formed at a position diametrically center thereof.

The bottom wall 67 connects between bottom end portions of the front side walls 36. The bottom wall 67 has a front end portion connected to a rear end portion of the front wall 55. A rear end portion of the bottom wall 67 defines a first open portion 69 along with a lower peripheral end portion of each rear side wall 37 and a lower peripheral end portion of the rear wall 61. The first open portion 69 thus has a generally rectangular shape in a plan view, as shown in FIG. 3.

Referring to FIG. 3, the upper frame 34 includes a pair of upper frame side walls 71 disposed in opposition to each other in the lateral direction and an upper wall 88 connecting between upper end portions of the upper frame side walls 71.

As shown in FIGS. 9A-9C, each upper frame side wall 71 has a frontward portion having a generally rectangular-shaped side view, and a rearward portion extending rearward from an upper-rear end portion of the frontward portion. The rearward portion also has a generally rectangular shape in a left side view.

Each upper frame side wall 71 includes a frame engaged portion 72 and an upper receiver 78, as shown in FIG. 3. Each frame engaged portion 72 is adapted to be engaged with each first frame engaging portion 38, and each upper receiver 78 is adapted to be coupled to each lower receiver 40 when the lower frame 33 and the upper frame 34 are combined (assembled to each other).

The frame engaged portion 72 extends frontward from a lower-front end portion of the upper frame side wall 71. The frame engaged portion 72 has a generally rectangular frame-like shape with upper and lower portions in communication with each other in the top-to-bottom direction. The frame engaged portion 72 has a laterally outer wall on which a pair of slits 73 is formed, and a laterally inner wall on which a protruding rib 75 is formed, the outer wall and the inner wall being in confrontation with each other in the lateral direction.

More specifically, each slit 73 has a generally U-shape, depressing downward from an upper peripheral end of the outer wall. The slits 73 are aligned in the front-to-rear direction to provide an engaged portion 74 therebetween on the outer wall. In other words, the engaged portion 74 is defined by the pair of slits 73 aligned in the front-to-rear direction. The protruding rib 75 is formed on an outer surface of the inner wall at a position opposing the engaged portion 74 in the lateral direction, i.e., at a position center of the outer surface of the inner wall in the front-to-rear direction. The protruding rib 75 has a generally rectangular shape in a plan view, protruding laterally outward and extending in the top-to-bottom direction.

The upper receiver 78 is provided at the frontward portion of each upper frame side wall 71. The upper receiver 78 includes an upper groove 80 and an upper collar 79. The upper groove 80 is depressed upward from a lower peripheral end of each upper frame side wall 71 to form a semi-circular shape in a left side view. The upper collar 79 is semi-cylindrical shaped, protruding laterally outward from a peripheral end portion of the upper groove 80 to provide a semi-circular shaped side view, following an outer contour of the upper groove 80.

Further, an upper groove 81 is formed above the upper collar 79 such that the upper groove 81 has an arcuate shape in conformance with an outer contour of the upper collar 79. Referring to FIG. 9A, the upper groove 81 has a front portion defining a wide-width groove 82 and a rear portion defining a narrow-width groove 83. The wide-width groove 82 has a width about twice as wide as that of the narrow-width groove 83.

Each upper frame side wall 71 further includes a depressed portion 77, as shown in FIGS. 3 and 9A-9C. The depressed portion 77 has a generally U-shaped side view, being depressed downward from an upper peripheral end of the frontward portion of each upper frame side wall 71.

The upper wall 88 has a generally rectangular shape in a plan view, extending in the lateral direction, as shown in FIG. 3. On the upper wall 88, a pair of penetrating holes 76, a pair of upper fixing portions 89, a pair of engaged holes 91 (see FIG. 12), and a wire-exposing groove 93 are formed.

Each penetrating hole 76 is formed on each lateral end portion of the upper wall 88 such that each penetrating hole 76 is continuous with each depressed portion 77 formed on each upper frame side wall 71. The penetrating hole 76 has a generally rectangular shape in a plan view and penetrates through the upper wall 88 in the top-to-bottom direction.

The upper fixing portions 89 are formed at a rear end portion of the upper wall 88 each at a position coincident with each lower fixing portion 65 of the lower frame 33 in the lateral direction (at each lateral end portion of the rear end portion of the upper wall 88). Each upper fixing portion 89 is depressed downward from an upper surface of the upper wall 88 and has a generally U-shape when viewed from its rear side. The upper fixing portion 89 has an upper surface on which a screw penetrating hole 90 is formed such that the screw penetrating hole 90 penetrates through the upper wall 88 in the top-to-bottom direction.

The engaged holes 91 are formed at the rear end portion of the upper wall 88 such that each engaged hole 91 is positioned to be coincident with each second frame engaging portion 62 in the lateral direction. Each engaged hole 91 has a generally rectangular shape in a plan view, penetrating through the upper wall 88 in the top-to-bottom direction.

The wire-exposing groove 93 is formed at a substantially center of the upper wall 88 in the front-to-rear direction, as shown in FIG. 3. The wire-exposing groove 93 has a generally rectangular shape in a plan view elongated in the lateral direction. The wire-exposing groove 93 also penetrates through the upper wall 88 in the top-to-bottom direction.

On the upper wall 88, the scorotron charger 4 and a cleaning unit 95 are provided.

Referring to FIG. 1, the scorotron charger 4 includes a charging wire 86 and a grid 87. The charging wire 86 is made of a tungsten wire, for example. The charging wire 86 extends in the lateral direction and has both axial end portions supported by the lateral end portions (right and left end portions) of the upper wall 88. The charging wire 86 spans across the upper wall 88 in the lateral direction such that the charging wire 86 is exposed outside through the wire-exposing groove 93.

The grid 87 has a generally U-shaped cross-section in a side view, whose open end is oriented upward. The grid 87 extends in the lateral direction and fixed to the upper wall 88 such that the charging wire 86 is surrounded by the grid 87. The grid 87 has a bottom wall (a wall opposite to the open end) that is exposed downward from a lower surface of the upper wall 88. The bottom wall of the grid 87 is positioned to face the photosensitive drum 3 (i.e., the bottom wall of the grid 87 is positioned between the charging wire 86 and the photosensitive drum 3) when the drum cartridge 22 is assembled, as shown in FIG. 1.

The cleaning unit 95 includes a pair of rail portions 92, an operation portion 84, a wire-nipping portion 96 (as an example of a claimed cleaning member) and a restricting portion 94.

Each rail portion 92 has a generally flat plate-like shape extending in the lateral direction. Each rail portion 92 is provided along each of front and rear peripheral edge portions of the wire-exposing groove 93.

The operation portion 84 is generally flat plate-like shaped, having a generally rectangular shape in a plan view. The operation portion 84 is placed on the pair of rail portions 92 such that the operation portion 84 is movable in the lateral direction along the rail portions 92. The operation portion 84 includes a protrusion 85 as an example of a claimed engagement portion. The protrusion 85 has a generally rectangular shape in a plan view and protrudes leftward from a left end portion of the operation portion 84.

The wire-nipping portion 96 is formed of a rectangular-shaped sponge material. As shown in FIG. 3, the wire-nipping portion 96 is supported to a lower surface of the operation portion 84 in a state where the wire-nipping portion 96 is deformed to nip the charging wire 86.

The restricting portion 94 is generally flat plate-like shaped, having a generally rectangular shape in a plan view. The restricting portion 94 is positioned to oppose right end portions of the rail portions 92 in the lateral direction from rightward thereof.

In this cleaning unit 95, the operation portion 84 is normally positioned on left end portions of the rail portions 92. This position of the operation portion 84 is referred to as a "home position" hereinafter. As the operation portion 84 is moved rightward from its home position along the pair of rail portions 92, the wire-nipping portion 96 wipes foreign matters away from the charging wire 86. The charging wire 86 is thus cleaned up.

When the operation portion 84 is moved to the right end portions of the pair of rail portions 92, a right end portion of the operation portion 84 is in abutment with a left end portion of the restricting portion 94, thereby restricting the operation portion 84 from moving further rightward. When the cleaning is finished, the operation portion 84 is again placed on the left end portions of the rail portions 92 (back to its home position).

(3) Drum Frame

Figure 2:
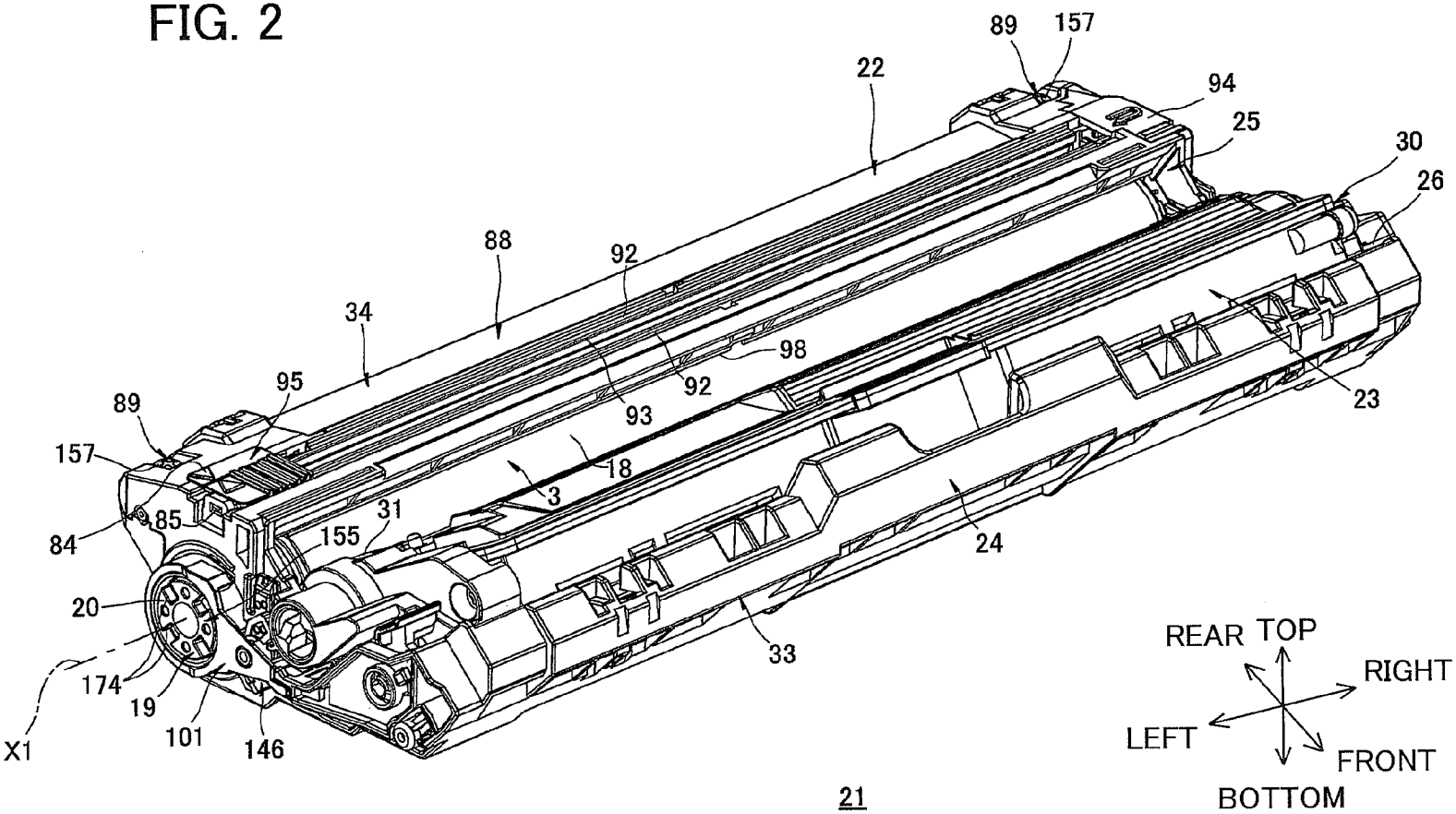
FIG. 2 is a perspective view of the process cartridge according to the present embodiment when viewed from leftward and upward thereof, the process cartridge including a drum cartridge and a developing cartridge.

Referring to FIG. 2, when the lower frame 33 and the upper frame 34 are mated with (assembled to) each other as will be described later, the drum cartridge frame 24 has a front portion defining a developing cartridge accommodating portion 26 and a rear portion defining a drum cartridge accommodating portion 25.

The drum cartridge accommodating portion 25 and the developing cartridge accommodating portion 26 are in communication with each other via a second opening portion 98, which is defined by a front end portion of the upper wall 88, a rear end portion of the bottom wall 67, inner surfaces of the upper frame side walls 71 and inner surfaces of the lower frame side walls 35.

(4) Developing Cartridge Accommodating Portion

Figure 8:
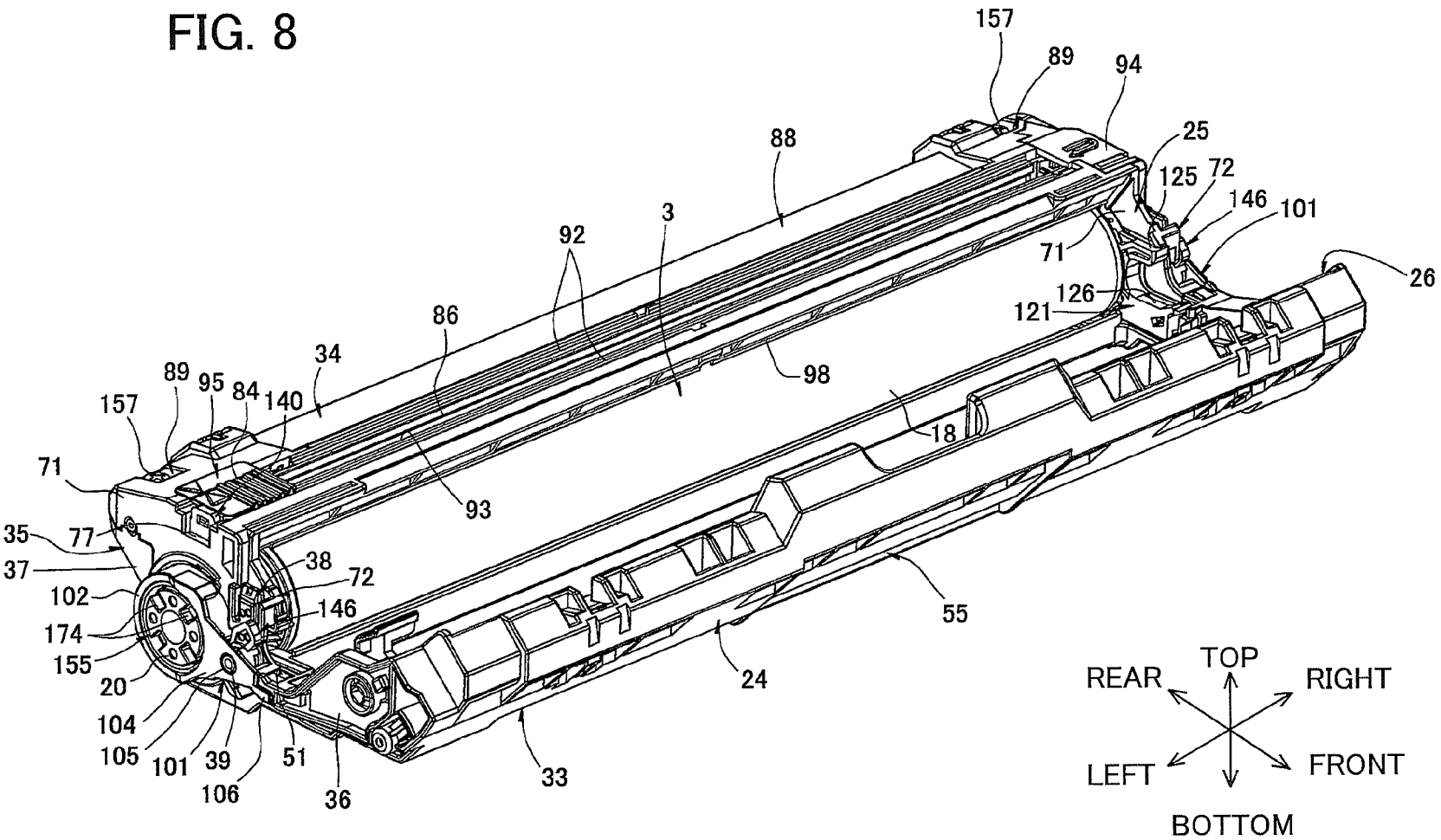
FIG. 8 is a perspective view of the drum cartridge according to the present embodiment when viewed from upward and leftward thereof.

As shown in FIG. 8, the developing cartridge accommodating portion 26 is defined specifically by the front side walls 36, the front wall 55 and the bottom wall 67. The developing cartridge accommodating portion 26 is open upward such that the developing cartridge 23 can be mounted on and removed from the developing cartridge accommodating portion 26.

(5) Drum Cartridge Accommodating Portion

Figure 6:
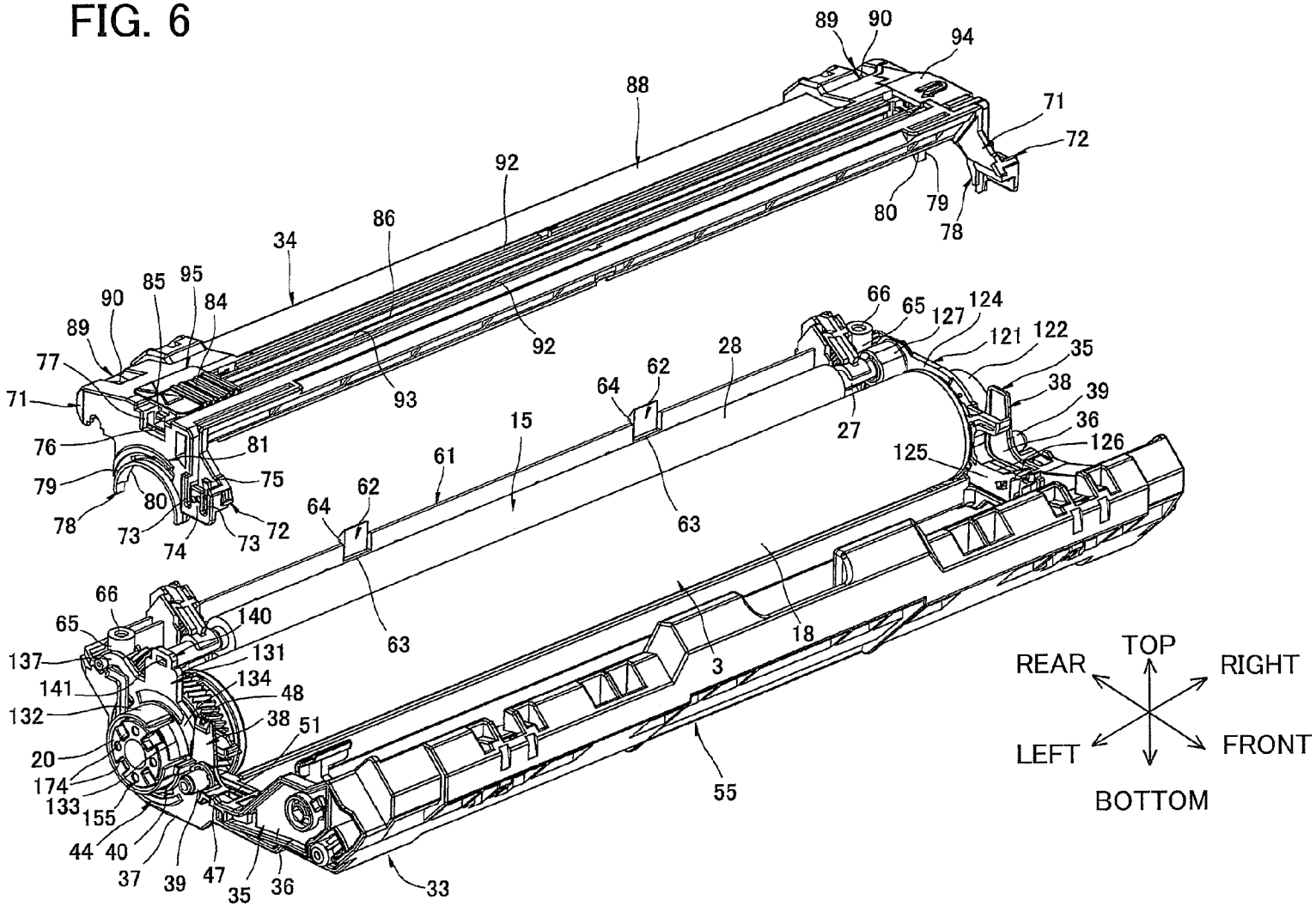
FIG. 6 is an explanatory view showing how the photosensitive drum of FIG. 5 is assembled to the lower frame and how the upper frame is subsequently assembled to the lower frame supporting the photosensitive drum.

Specifically, the drum cartridge accommodating portion 25 is defined by the lower frame 33 and the upper frame 34. In the drum cartridge accommodating portion 25, the photosensitive drum 3 and a drum cleaning roller 15 are accommodated, as shown in FIG. 6.

Figure 5:
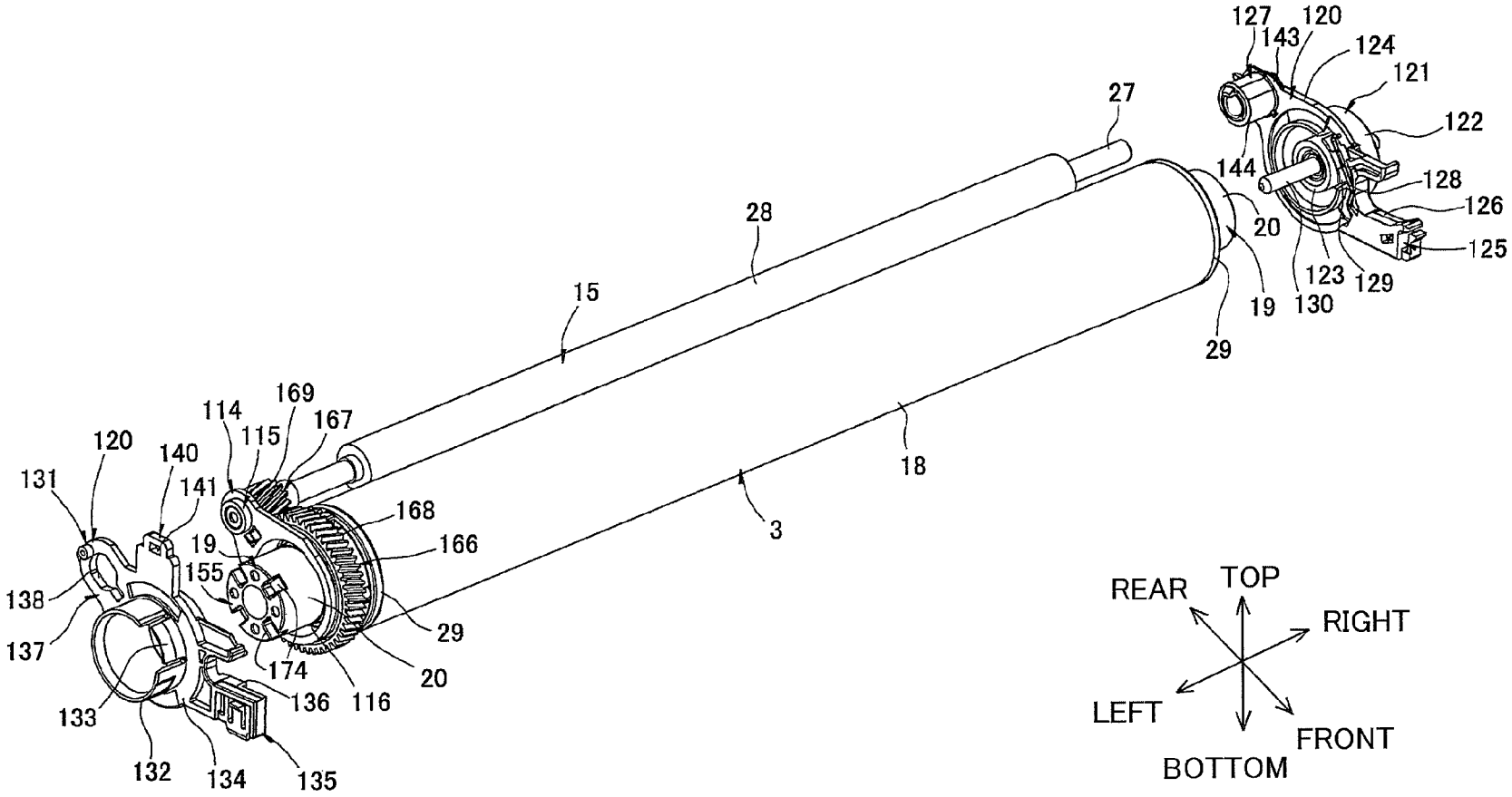
FIG. 5 is an explanatory view showing a photosensitive drum and a pair of bearing members assembled thereto.

The photosensitive drum 3 extends in an axial direction which is coincident with the lateral direction. The photosensitive drum 3 defines an axis X1 extending in the lateral direction (see FIG. 10). The photosensitive drum 3 includes a base cylinder 18 and a pair of flange portions 19, as shown in FIG. 5.

The base cylinder 18 is made of a metal, and has a generally cylindrical shape extending in the lateral direction. The base cylinder 18 has an outer circumferential surface which is coated with a photosensitive layer.

Each flange portion 19 is disposed on each axial end portion of the base cylinder 18. The flange portion 19 is made from a resin. Each flange portion 19 integrally includes a base-cylinder coupled portion 29 and a bearing coupled portion 20.

Each base-cylinder coupled portion 29 is coupled to (inserted into an internal space of) each axial end portion of the base cylinder 18 such that the base-cylinder coupled portion 29 is incapable of rotating relative to the base cylinder 18.

Each bearing coupled portion 20 is formed in a generally columnar shape protruding laterally outward from a central portion of each base-cylinder coupled portion 29. The bearing coupled portion 20 and the base-cylinder coupled portion 29 are coaxially positioned relative to each other.

On the bearing coupled portion 20 coupled to the left end portion of the base cylinder 18 (to be referred to as "left bearing coupled portion 20"), a photosensitive drum gear 166 is provided such that the photosensitive drum gear 166 is incapable of rotating relative to the left bearing coupled portion 20. The photosensitive drum gear 166 is ring-shaped, protruding radially outward from an outer peripheral surface of a right end portion of the left bearing coupled portion 20. The photosensitive drum gear 166 is formed with engageable teeth 168 on an outer circumferential surface thereof.

The left bearing coupled portion 20 also has a left end surface on which a drum driving-force inputting portion 155 is formed. The drum driving-force inputting portion 155 receives a driving force transmitted from a driving source (not shown) disposed within the main casing 2 when the process cartridge 21 is mounted in the main casing 2.

The drum driving-force inputting portion 155 is formed with four coupling holes 174 thereon. Each coupling hole 174 has a generally U-shape in a left side view which is open radially outward.

The coupling holes 174 are spaced away from one another at equi-intervals along a circumference of the drum driving-force inputting portion 155 such that the coupling holes 174 are positionally displaced by about 90 degrees relative to one another.

The drum cleaning roller 15 extends in the lateral direction. The drum cleaning roller 15 includes a cleaning roller shaft 27 extending in the lateral direction (axial direction) and a sponge roller 28 provided around the cleaning roller shaft 27.

At a left end portion of the cleaning roller shaft 27, a cleaning gear 167 is provided such that the cleaning roller gear 167 is incapable of rotating relative to the cleaning roller shaft 27. Specifically, the cleaning gear 167 is provided on an outer circumferential surface of the left end portion of the cleaning roller shaft 27. The cleaning gear 167 has an outer circumferential surface on which engaging teeth 169 are formed.

As shown in FIG. 5, the photosensitive drum 3 and the drum cleaning roller 15 are supported to a connecting member 114 and a pair of bearing members 120 such that the photosensitive drum 3 and the drum cleaning roller 15 are restricted from moving relative to each other.

The connecting member 114 is a flat plate-like member having a droplet-like shape in a side view. Specifically, the connecting member 114 has a rear portion whose width becomes narrower as extending rearward. The connecting member 114 is formed with a cleaning shaft insertion portion 115 and a flange penetrating hole 116.

The cleaning shaft insertion portion 115 is formed at a rear end portion of the connecting member 114. The cleaning shaft insertion portion 115 has a generally cylindrical shape protruding leftward from a left surface of the rear end portion of the connecting member 114. The cleaning shaft insertion portion 115 penetrates through the connecting member 114 in the lateral direction. The cleaning shaft insertion portion 115 has an inner diameter substantially identical to a diameter of the cleaning roller shaft 27.

The flange penetrating hole 116 is formed at a frontward portion of the connecting member 114. The flange penetrating hole 116 has a generally circular shape in a side view, and penetrates through the connecting member 114 in the lateral direction. The flange penetrating hole 116 has a diameter greater than an outer diameter of the bearing coupled portion 20.

The pair of bearing members 120 is formed of a polyacetal material, for example. The pair of bearing members 120 is configured of a right bearing member 121 and a left bearing member 131.

The right bearing member 121 integrally includes a cylindrical portion 122, a flange portion 124, a bearing guide portion 125 and a cleaning shaft supporting portion 127.

The cylindrical portion 122 has a generally cylindrical shape whose right end is closed (covered) by a right end wall (not shown). The cylindrical portion 122 has an inner diameter substantially identical to (slightly greater than) the outer diameter of the bearing coupled portion 20.

More specifically, the cylindrical portion 122 includes a shaft supporting portion 123 and a pressing portion 129.

The shaft supporting portion 123 is formed in a generally cylindrical shape to coaxially penetrate through the right end wall of the cylindrical portion 122 in the lateral direction. A shaft 130 extending in the lateral direction is held to the shaft supporting portion 123 at a position diametrically center thereof (the shaft 130 is positioned within an internal space of the shaft supporting portion 123).

The pressing portion 129 is a portion of the cylindrical portion 122, the portion being interposed between a pair of slits extending rightward from a left end portion of the cylindrical portion 122. A spring member 128 is disposed at an outer circumferential surface of the pressing portion 129 such that the pressing portion 129 is biased radially inward.

The flange portion 124 is generally flat plate-like shaped and has a generally circular ring-like shape in a side view. The flange portion 124 extends radially outward from an outer circumferential surface of the cylindrical portion 122 at a position mid-way thereof in the lateral direction.

The bearing guide portion 125 is generally flat plate-like shaped, extending frontward from a front portion of the flange portion 124. The bearing guide portion 125 has a front end portion on which a guide groove 126 is formed. The guide groove 126 has a generally U-shape in a side view that is depressed rearward from the front end portion of the bearing guide portion 125.

The cleaning shaft supporting portion 127 includes an extending portion 143 and a cylindrical portion 144.

The extending portion 143 has a generally flat plate-like shape extending diagonally upward and rearward from an upper-rear end portion of the flange portion 124. The cylindrical portion 144 has a generally cylindrical shape, penetrating through the extending portion 143 in the lateral direction.

The left bearing member 131 integrally includes a cylindrical portion 132, a flange portion 134, a bearing guide portion 135, a cleaning shaft receiving portion 137 and an engaging portion 140.

The cylindrical portion 132 has a generally cylindrical shape.

Specifically, the cylindrical portion 132 has an inner diameter substantially identical to (slightly larger than) the outer diameter of the bearing coupled portion 20, and an outer diameter substantially identical to an outer diameter of the cylindrical portion 122 of the right bearing member 121.

The cylindrical portion 132 is formed with a pressing portion 133. The pressing portion 133 is a portion of the cylindrical portion 132, the portion being interposed between a pair of slits extending rightward from a left end portion of the cylindrical portion 132.

The flange portion 134 is generally flat plate-like shaped and has a generally circular ring-like shaped side view. The flange portion 124 extends radially outward from an outer circumferential surface of the cylindrical portion 132 at a position mid-way thereof in the lateral direction.

The bearing guide portion 135 is generally flat plate-like shaped, extending frontward from a front end portion of the flange portion 134. The bearing guide portion 135 has a front end portion on which a guide groove 136 is formed. The guide groove 136 has a generally U-shape in a side view that is depressed rearward from the front end portion of the bearing guide portion 135.

The cleaning shaft receiving portion 137 is generally flat plate-like shaped, extending diagonally upward and rearward from an upper-rear end portion of the flange portion 134. The cleaning shaft receiving portion 137 is formed with a cleaning shaft receiving hole 138. The cleaning shaft receiving hole 138 has a generally circular shape in a side view, penetrating through a central portion of the cleaning shaft receiving portion 137 in the lateral direction. The cleaning shaft receiving hole 138 has an inner diameter substantially identical to an outer diameter of the cleaning shaft insertion portion 115 of the connecting member 114.

The engaging portion 140 is also flat plate-like shaped, extending upward from an upper end portion of the flange portion 134. The engaging portion 140 has an upper end portion on which an engaging hole 141 is formed.

Figure 7:
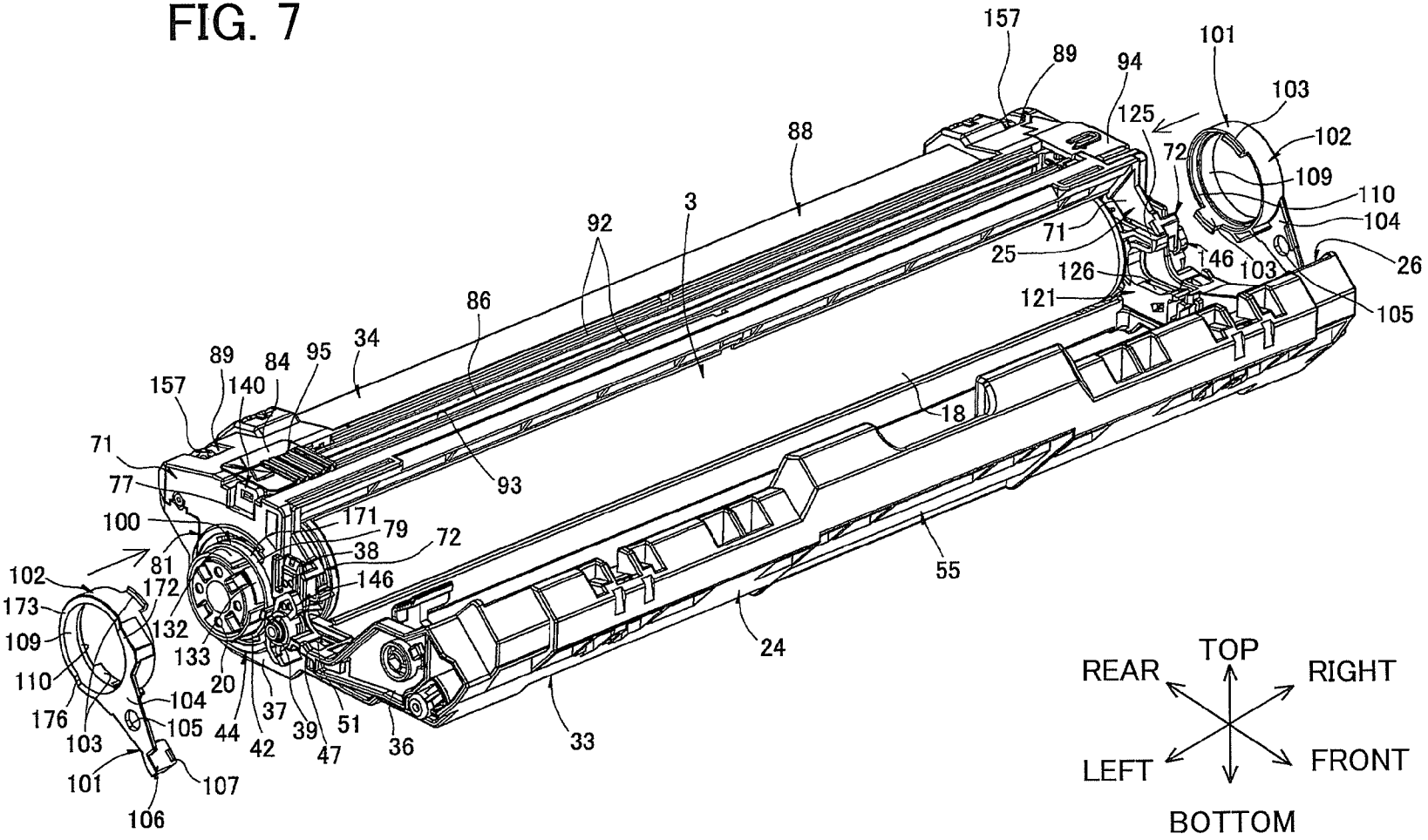
FIG. 7 is an explanatory view showing how the holding member is subsequently assembled to the upper and lower frame assembled to each other.

Referring to FIG. 7, a pair of holding members 101 and a pair of separating members 146 are also provided on the drum cartridge accommodating portion 25. Specifically, each holding member 101 and each separating member 146 are disposed on each side wall of the drum cartridge frame 24 (i.e., on each lower frame side wall 35 and each upper frame side wall 71).

Hereinafter, a detailed description will be given only on the holding member 101 and the separating member 146 disposed on the left side of the drum cartridge frame 24.

Figure 4A:
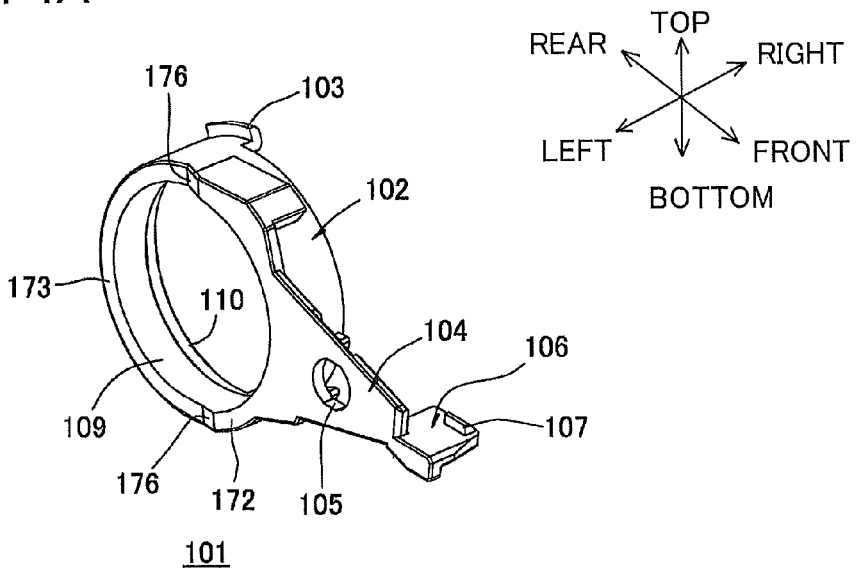
FIG. 4A is a perspective view of a holding member provided at the drum cartridge when viewed from upward and leftward thereof.
Figure 4B:
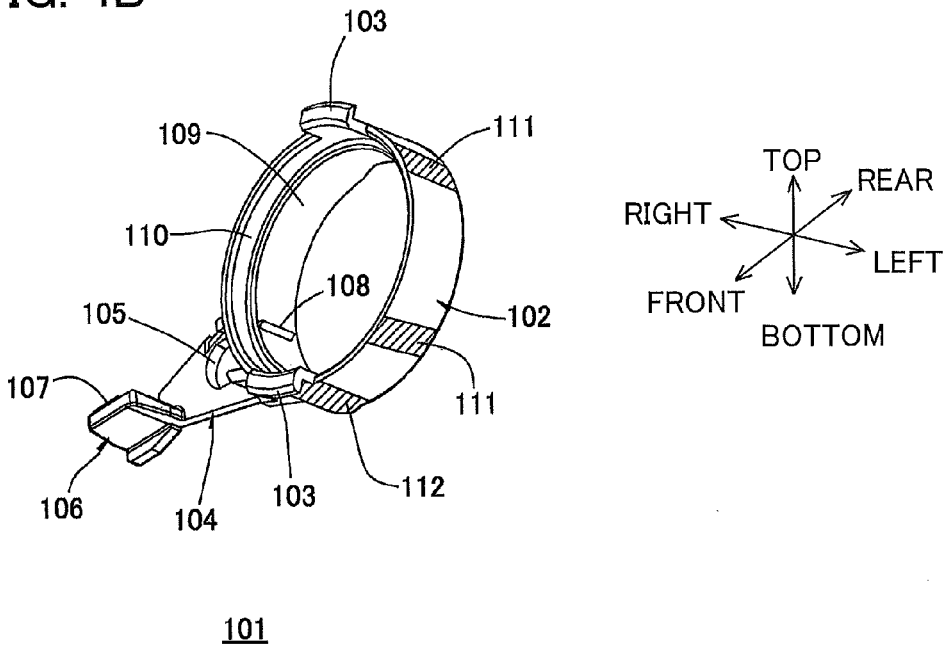
FIG. 4B is a perspective view of the holding member when viewed from downward and rightward thereof.

Each holding member 101 is made from a material having excellent slidability or a low friction coefficient (polyacetal, for example) relative to a main body guide section 153 (described later). Referring to FIGS. 4A and 4B, the holding member 101 includes a cylindrical portion 102, a cover portion 104 and an engaging portion 106.

The cylindrical portion 102 has a generally hollow cylindrical shape, having a right side portion serving as a larger-diameter portion 110 and a left side portion serving as a smaller-diameter portion 109.

The larger-diameter portion 110 has an inner diameter larger than that of the smaller-diameter portion 109. The inner diameter of the larger-diameter portion 110 is substantially identical to an outer diameter of a cylindrical-shaped collar portion 100 (described later) that is formed by the lower collar 42 and the upper collar 79.

The smaller-diameter portion 109 has an inner diameter substantially identical to the outer diameter of the cylindrical portion 132 of the left bearing member 131 (or the outer diameter of the cylindrical portion 122 of the right bearing member 121 in case of the holding member 101 disposed on the right side of the drum cartridge frame 24).

On an inner peripheral surface of the smaller-diameter portion 109, a protruding portion 108 is formed as an example of a claimed pressing portion, as shown in FIG. 4B. The protruding portion 108 protrudes radially inward from a front portion of the inner peripheral surface of the smaller-diameter portion 109. The protruding portion 108 has a triangular-shaped side view and extends in the lateral direction.

A pair of coupling protrusions 103 is also formed on the cylindrical portion 102 as an example of a claimed coupling portion. Specifically, the coupling protrusions 103 are formed on the larger-diameter portion 110 so as to diametrically oppose each other. Each coupling protrusion 103 is formed in a generally L-shape in a front side view, protruding rightward from a right end portion of the larger-diameter portion 110 and then bending radially outward of the cylindrical portion 102.

The cylindrical portion 102 has an outer circumferential surface whose lower portion is defined as a guided surface 112, which is a surface guided by the main body guide section 153 (described later) while the completed process cartridge 21 is being mounted in the main casing 2. Also, the outer circumferential surface of the cylindrical portion 102 has an upper-rear portion and a lower-rear portion each being defined as a positioned surface 111 (as an example of a claimed positioned portion), which is a surface brought into contact with a positioning section 154 (described later) disposed within the main casing 2 when the completed process cartridge 21 is mounted in the main casing 2 (see FIG. 10).

The cylindrical portion 102 has a rear portion 173 and a front portion 172. The rear portion 173 has a length (thickness) shorter than that of the front portion 172 in the lateral direction. The front portion 172 and the rear portion 173 are connected via two sloped surfaces 176, as shown in FIG. 4A. More specifically, the two sloped surfaces 176 are formed to diametrically oppose each other in the top-to-bottom direction, thereby connecting between a left surface of the front portion 172 and a left surface of the rear portion 173. Each sloped surface 176 slopes such that the sloped surface 176 approaches toward the larger-diameter portion 110 (rightward) as extends rearward.

The smaller-diameter portion 109 has a left end portion from whose front end portion the cover portion 104 extends frontward. The cover portion 104 is flat plate-shaped, having a generally triangular shaped side view. A separation shaft hole 105 is formed on the cover portion 104 at a position generally center thereof. The separation shaft hole 105 is generally circular shaped in a side view and penetrates through the cover portion 104 in the lateral direction.

On a front end portion of the cover portion 104, the engaging portion 106 is formed as an example of a claimed engaging portion. The engaging portion 106 is generally flat plate-like shaped and has a generally rectangular shape extending frontward and rightward in a top view. The engaging portion 106 has an upper surface on which a protrusion 107 is formed. The protrusion 107 has a generally rectangular-shaped side view, and protrudes upward from a right end portion of the upper surface of the engaging portion 106.

Referring to FIG. 9A, each separating member 146 integrally includes a shaft penetrating portion 147, a lower blade portion 148 and an upper blade portion 151.

The shaft penetrating portion 147 has a generally cylindrical shape extending in the lateral direction. The shaft penetrating portion 147 has an inner diameter substantially identical to a diameter of the separation shaft 39 formed on each rear side wall 37.

The lower blade portion 148 extends downward from a lower portion of the shaft penetrating portion 147. The lower blade portion 148 is generally flat plate-like shaped, and has a lower portion bending frontward. The lower portion of the lower blade portion 148 has a front surface serving as a pressed surface 150, which is configured to be pressed by a main body lever 162 (described later) when the developing roller 6 of the mounted developing cartridge 23 is separated from the corresponding photosensitive drum 3.

The upper blade portion 151 extends upward from an upper portion of the shaft penetrating portion 147. The upper blade portion 151 is generally flat plate-like shaped, and has an upper portion bending frontward. The upper portion of the upper blade portion 151 has a front surface serving as the abutment surface 149, which is configured to be in abutment with the abutment portion 159 formed on the developing cartridge 23 when the developing cartridge 23 is in the separation state. Details on how the separating members 146 function to separate the developing roller 6 from the photosensitive drum 3 will be described later.

(6) Assembly of Drum Cartridge

Next, how the drum cartridge 22 is assembled will be described. For assembling the drum cartridge 22, the connecting member 114 and the pair of bearing members 120 are first assembled to the photosensitive drum 3 and the drum cleaning roller 15, as shown in FIG. 5.

The left bearing coupled portion 20 of the photosensitive drum 3 is inserted into the flange penetrating hole 116 of the connecting member 114 from rightward thereof. At the same time, the left end portion of the cleaning roller shaft 27 is also inserted into the cleaning shaft insertion portion 115 of the connecting member 114 from rightward thereof. The connecting member 114 is thus assembled to the photosensitive drum 3 and the drum cleaning roller 15.

Then, the pair of bearing members 120 is assembled to the photosensitive drum 3 and the drum cleaning roller 15.

Specifically, the right bearing member 121 is assembled to the photosensitive drum 3 and the drum cleaning roller 15 from rightward thereof such that the bearing coupled portion 20 on the right side of the photosensitive drum 3 (to be referred to as "right bearing coupled portion 20") is inserted into the cylindrical portion 122 and the right end portion of the cleaning roller shaft 27 is inserted into the cleaning shaft supporting portion 127.

The left bearing member 131 is then assembled to the photosensitive drum 3 and the drum cleaning roller 15 from leftward thereof such that the left bearing coupled portion 20 is inserted into the cylindrical portion 132 and the cleaning shaft insertion portion 115 is inserted into the cleaning shaft receiving hole 138.

In this way, the bearing members 120 (the right bearing member 121 and the left bearing member 131) are assembled to the photosensitive drum 3 and the drum cleaning roller 15, thereby connecting the photosensitive drum 3 and the drum cleaning roller 15.

At this time, the engageable teeth 168 of the photosensitive drum gear 166 and the engaging teeth 169 of the cleaning gear 167 meshingly engage each other such that the driving force inputted to the photosensitive drum 3 is transmitted to the drum cleaning roller 15. Further, the photosensitive drum 3 is rotatably supported to the bearing members 120, since the cylindrical portion 122 of the right bearing member 121 and the cylindrical portion 132 of the left bearing member 131 both have diameters slightly larger than the outer diameter of each bearing coupled portion 20.

Next, the photosensitive drum 3 and the drum cleaning roller 15 are assembled to the lower frame 33, as shown in FIG. 6.

For assembling the photosensitive drum 3 and the drum cleaning roller 15 to the lower frame 33, the photosensitive drum 3 and the drum cleaning roller 15 are placed upward of the lower frame 33 and then assembled thereto such that a lower portion of each bearing coupled portion 20 of the photosensitive drum 3 positionally corresponds to each lower receiver 40 of the lower frame 33.

As a result, the flange portion 124 and the flange portion 134 are positioned to oppose respective inner surfaces of the rear side walls 37 in the lateral direction. Lower portions of the cylindrical portion 122 and the cylindrical portion 132 are thus respectively received by the lower receivers 40.

The photosensitive drum 3 and the drum cleaning roller 15 are thus assembled to (combined with) the lower frame 33. At this time, a lower portion of the base cylinder 18 of the photosensitive drum 3 is exposed downward through the first open portion 69.

Then, the upper frame 34 is assembled to the lower frame 33.

For assembling the upper frame 34 to the lower frame 33, the upper frame 34 is assembled to a rear portion of the lower frame 33 from above such that the first frame engaging portion 38 is positionally coincident with the frame engaged portion 72 in the front-to-rear direction, and the second frame engaging portions 62 are positionally coincident with the engaged holes 91 (see FIG. 12) in the lateral direction.

At this time, as shown in FIGS. 9A to 9C, the first frame engaging portion 38 is inserted into the frame engaged portion 72 from below. The first frame engaging portion 38 is then pressed laterally outward by the protruding rib 75 formed on the inner wall of the frame engaged portion 72. The hooked portion 48 is thus engaged with an upper peripheral end of the engaged portion 74.

Also, each second frame engaging portion 62 is inserted into the corresponding engaged hole 91 from below, thereby permitting the hook portion 64 to be engaged with an upper peripheral end of the corresponding engaged hole 91.

The upper frame 34 has thus been assembled to the lower frame 33, thereby defining the drum cartridge accommodating portion 25.

Upon completion of assembly of the upper frame 34 to the lower frame 33, each lower receiver 40 and each upper receiver 78 constitute a drum receiving portion 171 as an example of a claimed photosensitive member receiving portion, as shown in FIG. 7.

The drum receiving portion 171 includes a drum receiving hole (not shown) and the collar portion 100. Specifically, each lower receiving groove 43 and each upper groove 80 form the drum receiving hole (not shown) having a circular shaped side view, and each lower collar 42 and each upper collar 79 form the collar portion 100 of a generally cylindrical shape. In other words, the drum cartridge frame 24 is separable into the lower frame 33 and the upper frame 34 in the top-to-bottom direction along a boundary defined by the lower receiver 40 and the upper receiver 78. That is, the lower frame 33 provides a portion of the drum receiving portion 171 (the lower receiver 40) and the upper frame 34 provides a remaining portion of the drum receiving portion 171 (the upper receiver 78).

Also, upper portions of the cylindrical portion 122 and the cylindrical portion 132 are received by the respective upper receivers 78. In other words, an upper portion of each bearing coupled portion 20 is received by each upper receiver 78.

The upper frame 34 is then fixed to the lower frame 33 to complete the drum cartridge frame 24 as shown in FIG. 2.

Specifically, upon completion of the assembly of the upper frame 34 and the lower frame 33, the screw hole 66 of each lower fixing portion 65 is exposed through the screw penetrating hole 90 of the corresponding upper fixing portion 89. A screw member 157 is screwed into each screw hole 66 via the screw penetrating hole 90. The upper frame 34 is thus fixed to the lower frame 33 by these screw members 157, thereby completing the drum cartridge frame 24.

In the completed drum cartridge frame 24, both axial end portions of the photosensitive drum 3 are coupled to respective pairs of the lower receiver 40 and the upper receiver 78 such that the photosensitive drum 3 is rotatable about the axis X1 (see FIG. 10). The axis X1 of the photosensitive drum 3 serves as a rotational axis of the photosensitive drum 3 and therefore will be referred to as a "first rotational axis X1" hereinafter.

Further, as shown in FIGS. 9A to 9C, the upper portion of the engaging portion 140 of the left bearing member 131 penetrates through the penetrating hole 76 (FIGS. 3 and 6) from below to protrude upward of the depressed portion 77. The engaging hole 141 of the engaging portion 140 is therefore positioned to oppose the protrusion 85 of the operation portion 84 in the lateral direction (i.e., the engaging hole 141 is positioned leftward of the protrusion 85). With this structure, the protrusion 85 can be engaged with the engaging hole 141 when the operation portion 84 is positioned at the left end portion of the pair of rail portions 92 (at the home position).

Further, the wide-width groove 45 of the lower groove 44 and the wide-width groove 82 of the upper groove 81 diametrically oppose each other with respect to the photosensitive drum 3. Likewise, the narrow-width groove 46 of the lower groove 44 and the narrow-width groove 83 of the upper groove 81 also diametrically oppose each other with respect to the photosensitive drum 3 (see FIG. 9A).

Each bearing coupled portion 20 received by each collar portion 100 (that is, each bearing coupled portion 20 internally coupled to the cylindrical portion 122 or the cylindrical portion 132) protrudes laterally outward from the corresponding collar portion 100 (specifically, from an outer end portion of each collar portion 100 in the lateral direction).

Next, the pair of separating member 146 is assembled to the lower frame 33.

As shown in FIGS. 9A to 9B, for assembling the separating member 146 to the lower frame 33, the separating member 146 is attached to the lower frame 33 from laterally outward thereof such that the separation shaft 39 of the lower frame 33 penetrates through the shaft penetrating portion 147 of the separating member 146. At this time, the lower blade portion 148 of the separating member 146 is positioned below the separation shaft 39 in a state that the lower portion of the lower blade portion 148 is bent (oriented) frontward.

The pair of holding members 101 is subsequently assembled to the drum cartridge frame 24.

For assembling the holding members 101 to the drum cartridge frame 24, as shown in FIGS. 4 and 9A, each holding member 101 is attached to the drum cartridge frame 24 from laterally outward thereof such that the engaging portion 106 of the holding member 101 is positioned frontward and the pair of coupling protrusions 103 is inserted into the corresponding wide-width grooves 45, 82 from laterally outward thereof.

As a result, the cylindrical portions 122, 132 of the bearing members 120 (right bearing member 121 and the left bearing member 131) are internally coupled to the corresponding smaller-diameter portions 109 of the holding members 101 respectively, and each collar portion 100 of the drum cartridge frame 24 is internally coupled to the larger-diameter portion 110 of each holding member 101. In other words, each bearing coupled portion 20 of the photosensitive drum 3 is internally coupled to the cylindrical portion 102 and held by the holding member 101 via the cylindrical portion 122 or the cylindrical portion 132.

At this time, the cylindrical portion 102 of each holding member 101 is coaxially positioned relative to the photosensitive drum 3. In other words, the cylindrical portion 102 of each holding member 101 defines an axis coincident with the first rotational axis X1 of the photosensitive drum 3.

Then, the holding members 101 are engaged with the lower frame 33 and the upper frame 34.

Specifically, as shown in FIG. 9B, the holding member 101 is rotated in a direction Y (counterclockwise in a left side view) until the engaging portion 106 abuts on the engaged portion 47 of the lower frame 33 from below. Since the axis of the cylindrical portion 102 of the holding member 101 is coincident with the first rotational axis X1 of the photosensitive drum 3, each holding member 101 is also rotated about the first rotational axis X1.

In conjunction with rotation of the holding member 101, as shown in FIGS. 4 and 9C, each coupling protrusion 103 is also moved from the wide-width grooves 45, 82 to the narrow-width grooves 46, 83 along the lower groove 44 and the upper groove 81. Bent portions of the L-shaped coupling protrusions 103 are thus engaged with peripheral end portions of the narrow-width grooves 46, 83. In other words, the lower groove 44 and the upper groove 81 are respectively coupled to one of the coupling protrusions 103 as the holding member 101 is rotated.

The holding members 101 are thus engaged with the lower frame 33 and the upper frame 34 such that each holding member 101 covers the lower receiver 40 and the upper receiver 78.

Also, when the engaging portion 106 of the holding member 101 abuts on a lower surface of the engaged portion 47, the protrusion 107 is inserted into the engaging hole 51 (see FIG. 3) of the engaged portion 47 from below. The engaging portion 106 of each holding member 101 is thus engaged with the lower frame 33.

Assembly of the holding members 101 to the drum cartridge frame 24 (the lower frame 33 and the upper frame 34) is thus completed.

At this time, the protruding portion 108 formed on the cylindrical portion 102 of each holding member 101 presses the corresponding bearing coupled portion 20 toward the lower receiver 40 (precisely, toward an upper end portion of the lower receiver 40) via the cylindrical portion 122 or the cylindrical portion 132, as shown in FIG. 9C. A direction in which the protruding portion 108 presses the corresponding bearing coupled portion 20 is indicated by an arrow in FIG. 9C.

Further, in accordance with rotation of the holding member 101, the separation shaft 39 of the lower frame 33, which penetrates through the shaft penetrating portion 147 of the separating member 146, is inserted into the separation shaft hole 105 formed on the cover portion 104. The separating member 146 is thus supported to the lower frame 33 such that the separating member 146 is covered by the cover portion 104 of each holding member 101 from laterally outward.

The drum driving-force inputting portion 155 of the left bearing coupled portion 20 is accommodated within the cylindrical portion 102 in the lateral direction and thus protected by the same, as shown in FIG. 2.

Assembly of the drum cartridge 22 is thus completed. At this time, as shown in FIG. 8, a front portion of the base cylinder 18 of the photosensitive drum 3 is exposed frontward from the second opening portion 98.

(7) Attachment of Developing Cartridge to Drum Cartridge

For attaching the developing cartridge 23 to the drum cartridge 22, the developing cartridge 23 is simply inserted into the developing cartridge accommodating portion 26 of the drum cartridge 22 from above. The developing cartridge 23 is thus mounted on the drum cartridge 22, thereby the process cartridge 21 being completed.

When the process cartridge 21 is completed, as shown in FIG. 10, the lateral end portions of the front wall of the developing cartridge frame 30 are pushed (biased) toward the photosensitive drum 3 by the cylindrical portions 57 of the pressing mechanisms 56 due to the biasing forces of the spring members 58. Therefore, the rubber roller 17 of the developing roller 6 and the base cylinder 18 of the photosensitive drum 3 are in direct contact with each other.

Also, as shown in FIG. 10, in the completed process cartridge 21, the separating member 146 is positioned between a rotational center of the photosensitive drum 3 (the first rotational axis X1) and a rotational center of the developing roller 6 (the second rotational axis X2), when projected in the lateral direction.

3. Mounting of Process Cartridge in Main Casing

In order to mount the process cartridge 21 in the main casing 2, first the top cover 50 is opened. Each process cartridge 21 is inserted into its designated position within the main casing 2 (a prescribed position corresponding to each color) from above.

Referring to FIG. 10, while the process cartridge 21 is being inserted into the main casing 2, the guided surface 112 formed on the cylindrical portion 102 of each holding member 101 is guided downward and rearward along the main body guide sections 153 (as an example of a claimed guide section) provided in the main casing 2. The main body guide section 153 is generally flat plate-like shaped, extending diagonally downward and rearward (shown as a chain line in FIG. 10). The main body guide section 153 is made from an ABS (acrylonitrile butadiene styrene) material, for example.

Insertion of the process cartridge 21 into the main casing 2 is ended when each positioned surface 111 formed on the cylindrical portion 102 of each holding member 101 abuts on the positioning section 154 provided in the main casing 2. The positioning section 154 is formed to have a generally L-shaped side view, and shown as a solid line in FIG. 10.

Figure 12A:
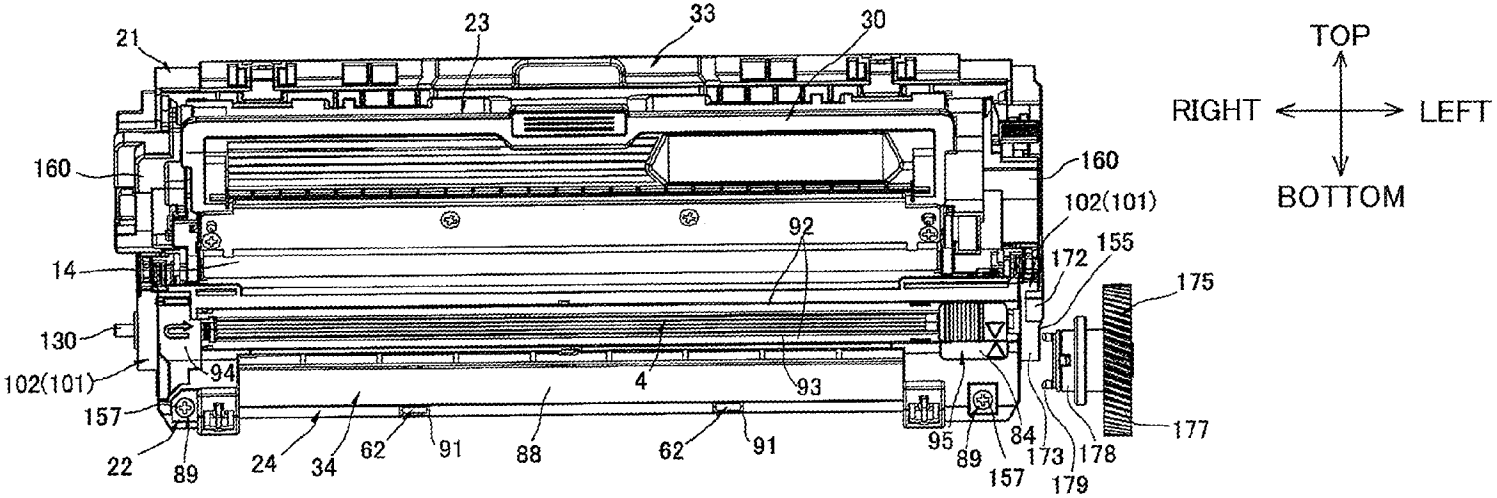

As described earlier, the drum driving-force inputting portion 155 is accommodated within the cylindrical portion 102 of the left bearing coupled portion 20, as shown in FIG. 12A. Therefore, during mounting of the process cartridge 21 into the main casing 2, the drum driving-force inputting portion 155 is suppressed from being damaged due to collision or interference with some other members provided in the main casing 2.

Further, as shown in FIG. 12A and described above with reference to FIG. 4A, in the holding member 101 attached on the left side of the process cartridge 21, the front portion 172 has a thickness thicker than that of the rear portion 173 in the lateral direction. In other words, the left surface of the rear portion 173 of the cylindrical portion 102 is positioned rightward relative to the left surface of the front portion 172 of the cylindrical portion 102 in the lateral direction. With this structure, while the process cartridge 21 is mounted in the main casing 2, the rear portion 173 of the holding member 101 is prevented from causing interference with other members in the main casing 2 (for example, a drum driving force transmission section 175 (described next)), thereby realizing a smooth mounting of the process cartridge 21 into the main casing 2.

Figure 12B:
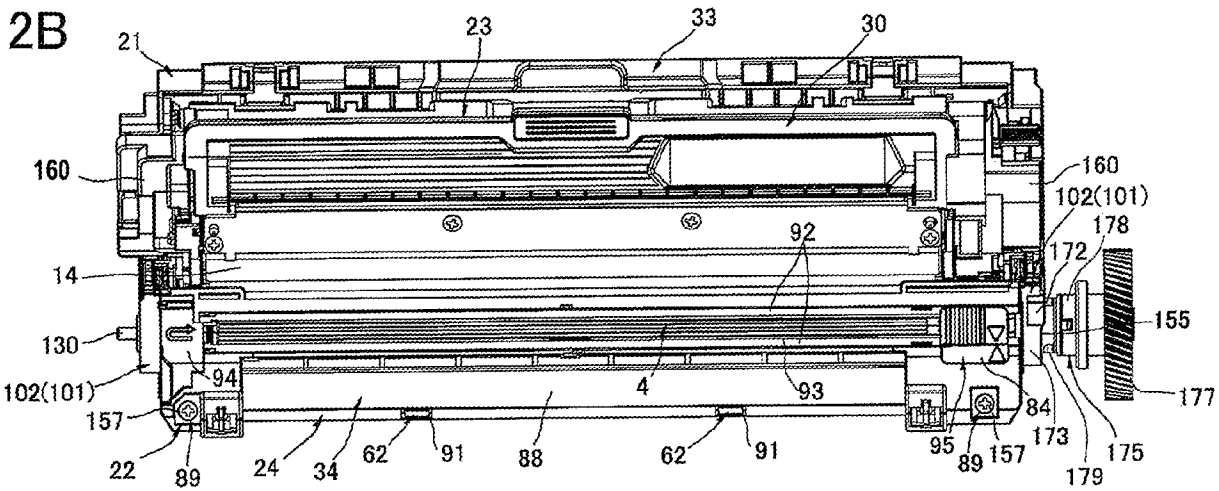

The drum driving force transmission section 175 is provided in the main casing 2 for transmitting the driving force from the driving source (not shown) disposed in the main casing 2 to the photosensitive drum 3. Specifically, the drum driving force transmission section 175 is disposed in the main casing 2 so as to oppose the drum driving-force inputting portion 155 of the photosensitive drum 3 from leftward thereof in the lateral direction when the process cartridge 21 has been completely mounted, as shown in FIG. 12B.

The drum driving force transmission section 175 is rotatable relative to the main casing 2. The drum driving force transmission section 175 has an engaging gear 177 on its left end, and a movable portion 178 on its right end.

The engaging gear 177 is generally disk-shaped. The engaging gear 177 has an outer circumferential surface on which gear teeth are formed so that the driving force transmitted from the driving source (not shown), such as a motor, can be inputted to the engaging gear 177.

The movable portion 178 is provided rightward of the engaging gear 177. The movable portion 178 is configured to advance and retract in the lateral direction in conjunction with movement (opening and closing movements) of the top cover 50. The movable portion 178 has a right end surface on which four engaging protrusions 179 are formed such that each engaging protrusion 179 is engageable with each coupling hole 174 formed on the drum driving-force inputting portion 155 (see FIG. 5).

When the top cover 50 is closed, mounting of the process cartridge 21 in the main casing 2 is completed. The process cartridge 21 is positioned relative to the main casing 2 when each positioned surface 111 abuts on the positioning section 154 of the main casing 2.

Figure 11:
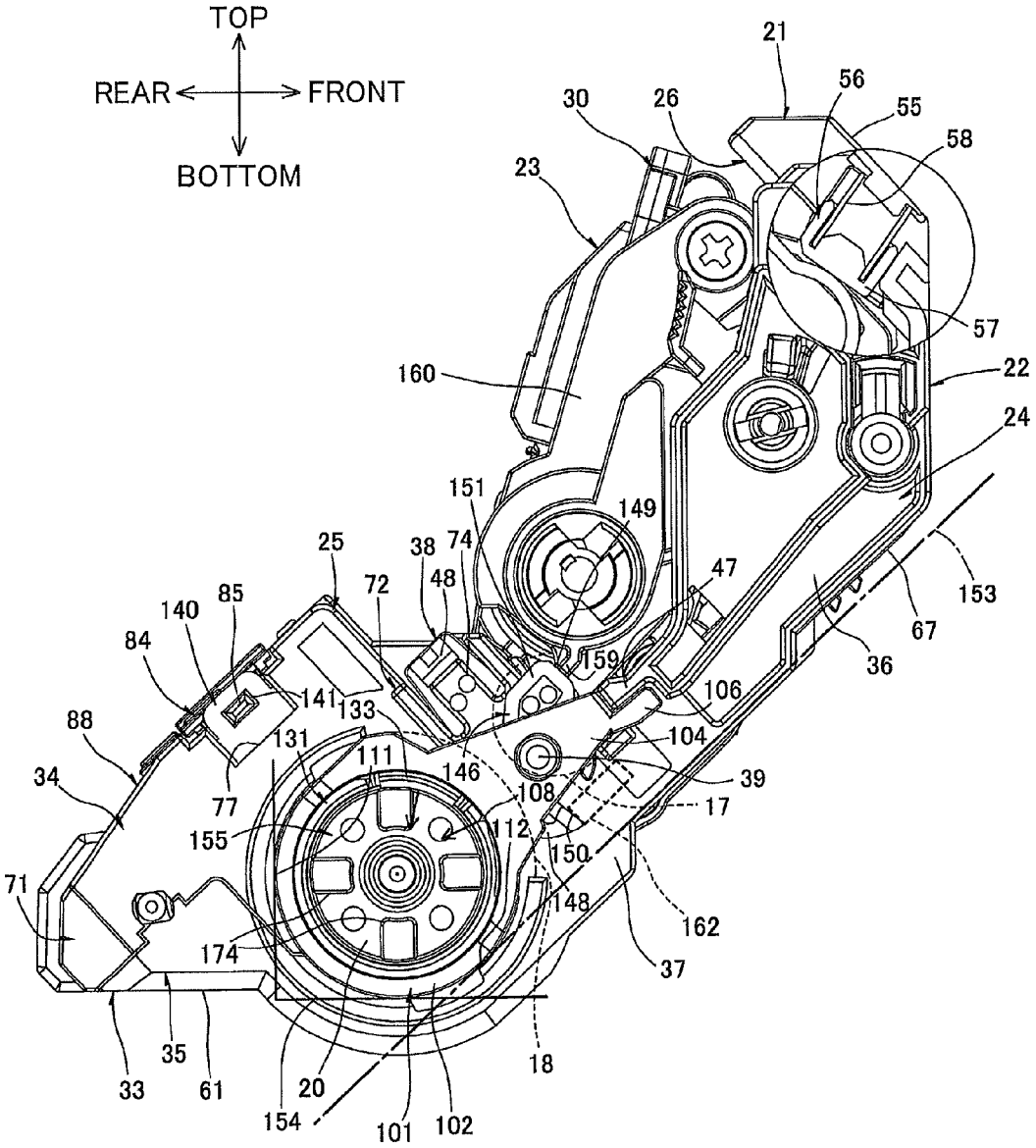
FIG. 11 is a left side view of the process cartridge of FIG. 2 in a state where the process cartridge has been mounted in the printer of FIG. 1, wherein the developing roller of the developing cartridge is separated from the photosensitive drum.

At this time, the protruding portion 108 of each holding member 101 is oriented (protrudes) toward the rear surface of the positioning section 154, as shown in FIG. 11. The protruding portions 108 thus serve to press the respective bearing coupled portions 20 toward the rear surface of the positioning section 154. Also, the pressing portions 129, 133 formed on the right bearing member 121 and the left bearing member 131 (see FIG. 5) respectively press the right and left bearing coupled portions 20 toward the bottom surface of the positioning section 154. In other words, each bearing coupled portion 20 is pressed toward the positioning section 154.

Further, in association with closing movement of the top cover 50, the movable portion 178 of the drum driving force transmission section 175 advances rightward such that the each engaging protrusion 179 is engaged with one of the coupling holes 174 formed on the drum driving-force inputting portion 155. As a result, the driving force from the driving source (not shown) disposed in the main casing 2 is transmitted to the photosensitive drum 3 via the drum driving force transmission section 175.

4. Separation of Developing Cartridge from Drum Cartridge

As described above, the rubber roller 17 of the developing roller 6 and the base cylinder 18 of the photosensitive drum 3 are normally in contact with each other. However, the rubber roller 17 and the base cylinder 18 sometimes need to be separated from each other, for example, when image formation is not performed in the printer 1.

For separating the developing roller 6 from the photosensitive drum 3, the main body lever 162 (shown as a dotted line in FIG. 11) is provided in the main casing 2.

Specifically, the main body lever 162 functions to push the pressed surface 150 of each separating member 146, which causes each separating member 146 to pivotally move clockwise in a left side view. The abutment surface 149 of each separating member 146 is therefore brought into abutment with the rear surface of the abutment portion 159 formed on the gear cover 160 of the developing cartridge 23.

As the main body lever 162 further presses the pressed surface 150, the abutment surface 149 pushes the corresponding abutment portion 159 frontward and upward such that the developing cartridge 23 is moved frontward and upward against the biasing force of the pressing mechanisms 56. The rubber roller 17 of the developing roller 6 and the base cylinder 18 of the photosensitive drum 3 are thus separated from each other.

5. Advantageous Effects (1) As described above, the drum cartridge frame 24 of the drum cartridge 22 includes the lower frame 33 and the upper frame 34 separable from each other in the top-to-bottom direction. The lower frame 33 has the pair of lower receivers 40 and the upper frame 34 has the pair of upper receivers 78 such that, upon mating the lower frame 33 with the upper frame 34, each lower receiver 40 and each upper receiver 78 forms each drum receiving portion 171 for receiving each axial end portions of the photosensitive drum 3. Specifically, for assembling the drum cartridge frame 24, each bearing coupled portion 20 of the photosensitive drum 3 is received by the lower receiver 40 such that the photosensitive drum 3 is assembled to the lower frame 33 (see FIG. 6). Subsequently, the upper frame 34 is assembled to the lower frame 33 such that the upper portion of each bearing coupled portion 20 is received by the upper receiver 78 (see FIG. 7).

The assembly of the photosensitive drum 3 relative to the drum cartridge frame 24 (the lower frame 33 and the upper frame 34) can be thus facilitated.

Further, the pair of holding members 101 is assembled to the drum cartridge frame 24 with which the photosensitive drum 3 has been combined. Upon completion of assembly of the holding members 101 to the drum cartridge frame 24 having the photosensitive drum 3, the cylindrical portion 102 of each holding member 101 supports each bearing coupled portion 20 of the photosensitive drum 3, while the coupling protrusions 103 of each holding member 101 are engaged with the narrow-width groove 46 formed on the lower frame 33 and the narrow-width groove 83 formed on the upper frame 34 respectively.

With this structure, rigidity of the drum cartridge frame 24 can be enhanced, in other words, the lower frame 33 and the upper frame 34 can be assembled to each other tightly and stably. Therefore, the photosensitive drum 3 can be positioned relative to the drum cartridge frame 24 with high accuracy.

In the drum cartridge 22 of the present embodiment, therefore, the assembly of the photosensitive drum 3 to the drum cartridge frame 24 can be smoothly performed, while the positioning accuracy of the photosensitive drum 3 relative to the drum cartridge frame 24 can be improved.

(2) The pair of bearing members 120 (the right bearing member 121 and the left bearing member 131) is made from a material having excellent slidability (having a low friction coefficient), such as a polyacetar material. The bearing coupled portions 20 of the photosensitive drum 3 are internally coupled to the cylindrical portion 122 of the right bearing member 121 and the cylindrical portion 132 of the left bearing member 131 respectively such that the photosensitive drum 3 is rotatably supported to the pair of the right bearing member 121 and the left bearing member 131.

Such simple-structured bearing members 120 can ensure smooth rotation of the photosensitive drum 3.

Incidentally, the bearing members 120 are likely to be susceptible to attrition since the bearing members 120 rotatably support the photosensitive drum 3. However, even in case that the bearing member 120 is abraded, the worn-out bearing member 120 only can be replaced. Maintenance of the drum cartridge 22 can be thus efficiently performed. And, since only the bearing member 120 is made from a polyacetal material which has excellent sliding performance, production costs of the drum cartridge 22 can be reduced.

(3) The holding member 101 includes the engaging portion 106 on which the protrusion 107 is formed. As shown in FIG. 9B, when the holding member 101 is rotated in the direction Y (counterclockwise in a left side view), the engaging portion 106 is engaged with the engaged portion 47 of the lower frame 33 such that the engaging portion 106 contacts the lower surface of the engaged portion 47 and the protrusion 107 is inserted into the engaging hole 51 formed on the engaged portion 47 from below.

With this structure, the holding member 101 can be stably positioned relative to the lower frame 33. The pair of holding members 101 can be thus reliably engaged with and held to the drum cartridge frame 24. Simply rotating the holding member 101 can be realize engagement of the holding member 101 with the lower frame 33, thereby facilitating assembly of the holding member 101 to the drum cartridge frame 24.

(4) The lower groove 44 of the lower frame 33 and the upper groove 81 of the upper frame 34 are formed such that the lower groove 44 and upper groove 81 can receive the coupling protrusions 103 of each holding member 101 in a state that each coupling protrusion 103 is slidingly movable relative to the lower groove 44 and the upper groove 81. Even in this state where the coupling protrusions 103 of the holding member 101 are slidingly movably coupled to the lower groove 44 and the upper groove 81, the holding member 101 is rotatable relative to the lower frame 33 and the upper frame 34.

Therefore, engagement of the engaging portion 106 of each holding member 101 with the corresponding engaged portion 47 of the lower frame 33 can be easily realized.

(5) The cylindrical portion 102 of each holding member 101 is formed with the protruding portion 108 thereon. The protruding portion 108 is integral with the cylindrical portion 102 and protrudes radially inward from the inner peripheral surface of the cylindrical portion 102. The protruding portion 108 serves to press the corresponding bearing coupled portion 20 toward the upper end portion of the lower receiver 40 via the cylindrical portion 122 or the cylindrical portion 132, as shown in FIG. 9C.

This construction allows each bearing coupled portion 20 of the photosensitive drum 3 to be positioned relative to the lower receiver 40. Therefore, positioning accuracy of the photosensitive drum 3 relative to the drum cartridge frame 24 can be improved.

(6) The scorotron charger 4 for charging the photosensitive drum 3 and the cleaning unit 95 for cleaning the charging wire 86 of the scorotron charger 4 are provided on the upper wall 88 of the upper frame 34.

The cleaning unit 95 also includes the movable operation portion 84 on whose left end portion the protrusion 85 is formed. When the operation portion 84 is at its home position (on the left end portions of the rail portions 92), the protrusion 85 is inserted into the engaging hole 141 formed on the engaging portion 140 of the left bearing member 131 for engagement with the same. With this structure, the operation portion 84 is prevented from coming off from the rail portions 92.

(7) The process cartridge 21 includes the drum cartridge 22 having the photosensitive drum 3, and the developing cartridge 23 having the developing roller 6 and detachably mountable on the drum cartridge 22.

When the developing cartridge 23 is mounted on the drum cartridge 22, the rubber roller 17 of the developing roller 6 is in direct contact with the base cylinder 18 of the photosensitive drum 3. Therefore, the photosensitive drum 3 is accurately positioned relative to the drum cartridge frame 24, thereby realizing accurate positioning of the developing roller 6 relative to the photosensitive drum 3.

(8) The pair of separating members 146 is disposed on the process cartridge 21. Each separating member 146 is pivotally movably supported to the separation shaft 39 of the lower frame 33. In a state where the developing cartridge 23 is mounted on the drum cartridge 22, the separating member 146 is positioned between the rotational axis of the photosensitive drum 3 (the first rotational axis X1) and the rotational axis of the developing roller 6 (the second rotational axis X2) when projected in the lateral direction.

The separating member 146 is configured to press the abutment portion 159 formed on each gear cover 160 of the developing cartridge 23, thereby separating the rubber roller 17 of the developing roller 6 from the base cylinder 18 of the photosensitive drum 3.

In this way, such simple-structured separating member 146 can reliably perform separation and contact between the rubber roller 17 of the developing roller 6 and the base cylinder 18 of the photosensitive drum 3. Since the separating member 146 is disposed at a position adjacent to the developing roller 6, displacement of the developing roller 6 (separation and contact) relative to the photosensitive drum 3 can be further reliably performed.

(9) Each holding member 101 includes the cover portion 104. The cover portion 104 serves to cover each separating member 146 from outward in the lateral direction for permitting the separating member 146 to be held to the lower frame 33. Undesired contact of the separating member 146 with its surroundings in the lateral direction can also be prevented.

(10) The process cartridge 21 is detachably mountable in the main casing 2. As described above, in the process cartridge 21, positioning accuracy between the photosensitive drum 3 and the drum cartridge frame 24 can be enhanced. Hence, the photosensitive drum 3 can also be accurately positioned relative to the main casing 2.

(11) The positioning section 154 is arranged in the main casing 2. Each holding member 101 is formed with the positioned surfaces 111 serving to position the process cartridge 21 relative to the main casing 2.

When the process cartridge 21 is mounted in the main casing 2, the positioned surfaces 111 are in abutment with the positioning section 154 of the main casing 2, thereby achieving positioning of the process cartridge 21 relative to the main casing 2. In this way, positioning of the process cartridge 21 relative to the main casing 2 can be further improved. In other words, accurate positioning of the photosensitive drum 3 relative to the main casing 2 can be realized.

(12) The main body guide sections 153 are also provided in the main casing 2. The cylindrical portion 102 of each holding member 101 is formed with the guided surface 112.

During mounting of the process cartridge 21 into the main casing 2, the guided surface 112 of each holding member 101 is guided along the corresponding main body guide section 153. Mounting of the process cartridge 21 into the main casing 2 is thus facilitated.

(13) The holding member 101 is made from a polyacetal material, whereas the drum cartridge frame 24 (the lower frame 33 and the upper frame 34) is made from a polystyrene material. In other words, the holding member 101, which has the guided surface 112 that is guided during mounting of the process cartridge 21 into the main casing 2, is made from a material whose slidability is higher (better) than that of the drum cartridge frame 24 (the lower frame 33 and the upper frame 34). The sliding performance of the holding member 101 is also better than that of the main body guide section 15 made from an ABS (acrylonitrile butadiene styrene) material. Hence, mounting of the process cartridge 21 into the main casing 2 is further facilitated.

(14) The protruding portion 108 formed on each holding member 101 is formed to protrude toward the rear surface of the positioning section 154, when the process cartridge 21 is mounted in the main casing 2. Each bearing coupled portion 20 of the photosensitive drum 3 is therefore pressed toward the rear surface of the positioning section 154 by the corresponding protruding portion 108.

As a result, the photosensitive drum 3 can be positioned relative to the positioning section 154 of the main casing 2 via the lower frame 33 and the upper frame 34. Accurate positioning of the photosensitive drum 3 relative to the main casing 2 can be thus further enhanced.

While the invention has been described in detail with reference to the embodiments thereof, it would be apparent to those skilled in the art that various changes and modifications may be made therein without departing from the spirit of the invention.

What is claimed is:

1. A photosensitive member cartridge comprising:

a photosensitive member defining a first axis extending in an axial direction and configured to rotate about the first axis, the photosensitive member having axial end portions opposite to each other in the axial direction;

a frame including a pair of photosensitive member receiving portions configured to receive the axial end portions of the photosensitive member, the frame comprising a first frame and a second frame separable from each other in a prescribed direction perpendicular to the axial direction and mating with each other such that the first frame provides a part of each photosensitive member receiving portion and the second frame provides a remaining part of each photosensitive member receiving portion; and a pair of holding members configured to hold the axial end portions of the photosensitive member, each holding member being engaged with both of the first frame and the second frame.

2. The photosensitive member cartridge according to claim 1, further comprising a pair of bearing members configured to rotatably support the axial end portions of the photosensitive member, wherein each of the holding members is configured to hold each axial end portion of the photosensitive member via each one of the bearing members.

3. The photosensitive member cartridge according to claim 2, wherein the second frame includes a scorotron charger and a cleaning unit;

wherein the scorotron charger includes a charging wire extending in the axial direction for charging the photosensitive member; and wherein the cleaning unit includes:

a cleaning member movable in the axial direction and along the charging wire for cleaning the charging wire; and an operation portion configured to move in the axial direction for moving the cleaning member along the charging wire, the operation portion including an engagement portion configured to be engaged with one of the bearing members when the operation portion is positioned at one end of the charging wire in the axial direction.

4. The photosensitive member cartridge according to claim 1, wherein each of the holding members is formed with an engaging portion configured to be engaged with the first frame upon rotation of the holding member about the first axis.

5. The photosensitive member cartridge according to claim 4, wherein each holding member further includes a coupling portion configured to be coupled to the first frame and the second frame.

6. The photosensitive member cartridge according to claim 5, wherein the first frame is formed with a first groove and the second frame is formed with a second groove; and wherein the holding member is rotatable about the first axis in a state where the coupling portion is coupled to the first groove and the second groove for engaging the holding member to the first frame and the second frame.

7. The photosensitive member cartridge according to claim 1, wherein each holding member comprises a hollow cylindrical portion configured to internally accommodate therein each axial end portion of the photosensitive member, the cylindrical portion being provided with a pressing portion configured to press each axial end portion of the photosensitive member toward each photosensitive member receiving portion of the frame.

8. The photosensitive member cartridge according to claim 7, wherein the cylindrical portion has an inner peripheral surface, the pressing portion being integrally formed with the cylindrical portion such that the pressing portion protrudes radially inward from the inner peripheral surface of the cylindrical portion.

9. A process cartridge comprising:

a photosensitive member cartridge; and a developing cartridge detachably mountable on the photosensitive member cartridge;

wherein:

the photosensitive member cartridge comprises:

a photosensitive member defining a first axis extending in an axial direction and configured to rotate about the first axis, the photosensitive member having axial end portions opposite to each other in the axial direction;

a frame including a pair of photosensitive member receiving portions configured to receive the axial end portions of the photosensitive member, the frame comprising a first frame and a second frame separable from each other in a prescribed direction perpendicular to the axial direction and mating with each other such that the first frame provides a part of each photosensitive member receiving portion, and the second frame provides a remaining part of each photosensitive member receiving portion; and a pair of holding members configured to hold the axial end portions of the photosensitive member, each holding member being engaged with both of the first frame and the second frame; and the developing cartridge comprises:

a developing frame having end portions opposite to each other in the axial direction; and a developer carrying member defining a second axis extending in the axial direction and configured to rotate about the second axis, the developer carrying member being rotatably supported to the end portions of the developing frame, the developer carrying member being in confrontation with and in contact with the photosensitive member when the developing cartridge is mounted on the photosensitive member cartridge.

10. The process cartridge according to claim 9, wherein the photosensitive member cartridge further includes a pair of separation members configured to separate the developer carrying member from the photosensitive member when the developing cartridge is mounted on the photosensitive member, each separation member being disposed at a position between the first axis and the second axis when projected in the axial direction, the separation members being configured to press the end portions of the developing frame in a direction away from the photosensitive member to separate the developer carrying member from the photosensitive member.

11. The process cartridge according to claim 10, wherein each holding member further includes a cover portion configured to cover the corresponding separation member from outward in the axial direction, the separation member being supported to the first frame by the cover portion.

12. An image forming apparatus comprising:

a process cartridge including a photosensitive member cartridge and a developing cartridge detachably mountable on the photosensitive member cartridge; and a main casing in which the process cartridge is detachably mountable, wherein:

the photosensitive member cartridge comprises:

a photosensitive member defining a first axis extending in an axial direction and configured to rotate about the first axis, the photosensitive member having axial end portions opposite to each other in the axial direction;

a frame including a pair of photosensitive member receiving portions configured to receive the axial end portions of the photosensitive member, the frame comprising a first frame and a second frame separable from each other in a prescribed direction perpendicular to the axial direction and mating with each other such that the first frame provides a part of each photosensitive member receiving portion, and the second frame provides a remaining part of each photosensitive member receiving portion; and a pair of holding members configured to hold the axial end portions of the photosensitive member, each holding member being engaged with both of the first frame and the second frame; and the developing cartridge comprises:

a developing frame having end portions opposite to each other in the axial direction; and a developer carrying member defining a second axis extending in the axial direction and configured to rotate about the second axis, the developer carrying member being rotatably supported to the end portions of the developing frame, the developer carrying member being in confrontation with and in contact with the photosensitive member when the developing cartridge is mounted on the photosensitive member cartridge.

13. The image forming apparatus according to claim 12, wherein the main casing includes a positioning section configured to position the process cartridge relative to the main casing, and wherein the process cartridge includes a positioned portion configured to abut the positioning section when the process cartridge is mounted in the main casing, the process cartridge being positioned relative to the main casing as a result of abutment of the positioned portion of the process cartridge with the positioning section of the main casing.

14. The image forming apparatus according to claim 13, wherein:

each holding member comprises a hollow cylindrical portion configured to internally accommodate therein each axial end portion of the photosensitive member, the cylindrical portion being provided with a pressing portion configured to press each axial end portion of the photosensitive member toward the corresponding photosensitive member receiving portion of the frame;

the cylindrical portion has an inner peripheral surface, the pressing portion being integrally formed with the cylindrical portion such that the pressing portion protrudes radially inward from the inner peripheral surface of the cylindrical portion; and the pressing portion protrudes toward the positioning section when the process cartridge is mounted in the main casing.

15. The image forming apparatus according to claim 12, wherein the main casing further includes a guide section configured to guide mounting of the process cartridge into the main casing, and wherein one of the holding members is guided along the guide section when the process cartridge is being mounted into the main casing.

16. The image forming apparatus according to claim 15, wherein the holding member is made from a material having slidability higher than that of the first frame and the second frame.

* * * * *